US005896145A

United States Patent [19]

Osborne et al.

[11] Patent Number: 5,896,145

[45] Date of Patent: *Apr. 20, 1999

[54] ORTHOGONAL ROTARY WIPING SYSTEM FOR INKJET PRINTHEADS

[75] Inventors: William S. Osborne; Bret Taylor, both of Vancouver; Patrick J. Therien, Battle Ground, all of Wash.

[73] Assignee: Hewlett-Packard Company, Palo Alto, Calif.

[ * ] Notice: This patent is subject to a terminal disclaimer.

[21] Appl. No.: 08/752,861

[22] Filed: Nov. 20, 1996

Related U.S. Application Data

[63] Continuation of application No. 08/330,461, Oct. 28, 1994, Pat. No. 5,614,930, which is a continuation-in-part of application No. 08/218,391, Mar. 25, 1994, Pat. No. 5,617,124.

[51] Int. Cl.[6] ..... B41J 2/165

[52] U.S. Cl. ..... 347/33; 347/22

[58] Field of Search ..... 347/22, 23, 33; 15/250.48, 256.5, 256.51, 256.52

[56] References Cited

U.S. PATENT DOCUMENTS

| | | | |
|---|---|---|---|
| 4,306,245 | 12/1981 | Kasugayama et al. | 346/140 R |
| 4,853,717 | 8/1989 | Harmon et al. | 346/140 R |
| 4,935,753 | 6/1990 | Lehmann et al. | 346/140 |

(List continued on next page.)

FOREIGN PATENT DOCUMENTS

| | | | |
|---|---|---|---|
| 0465260 | 1/1992 | European Pat. Off. | B41J 2/165 |
| 0513833 | 11/1992 | European Pat. Off. | B41J 2/165 |
| 602646 | 6/1994 | European Pat. Off. | B41J 2/165 |
| 0671272 | 9/1995 | European Pat. Off. | B41J 2/165 |
| 59-45162 | 3/1984 | Japan | 347/33 |
| 59-45163 | 3/1984 | Japan | 347/33 |
| 209876 | 11/1984 | Japan | 347/33 |
| 59-209876 | 11/1984 | Japan | 347/33 |
| 62-111751 | 5/1987 | Japan . | |
| A2231143 | 7/1990 | Japan | B41J 2/165 |
| A2235761 | 9/1990 | Japan | B41J 2/165 |
| 3-90362 | 4/1991 | Japan | 347/33 |
| 3-99857 | 4/1991 | Japan | 347/33 |
| 3-189163 | 8/1991 | Japan | B41J 2/175 |
| 4-37556 | 2/1992 | Japan | 347/33 |
| 4.77263 | 3/1992 | Japan . | |
| A4110156 | 4/1992 | Japan | B41J 2/165 |
| A4141440 | 5/1992 | Japan | B41J 2/165 |
| 4-338552 | 11/1992 | Japan | 347/33 |
| A5116331 | 5/1993 | Japan | B41J 2/165 |
| 6-143597 | 5/1994 | Japan | B41J 2/165 |

OTHER PUBLICATIONS

English language translation of Japan Patent No. 59–45162, already of record.

English language translation of Japan Patent No. 4–37555, sent to Applicant with Office Action dated Feb. 26, 1996, but not cited on form PTO 892.

English language translation of Japan Patent No. 4–37556, already of record.

*Primary Examiner*—Benjamin R. Fuller
*Assistant Examiner*—Craig A. Hallacher
*Attorney, Agent, or Firm*—Flory L. Martin

[57] ABSTRACT

A rotary self-cleaning servicing system services inkjet printheads in an inkjet printing mechanism. A rotary service station has a wiper supporting tumbler that rotates about an axis parallel to the printhead scanning direction to wipe the printhead orthogonally along the length of a linear nozzle array. A dual blade wiper has a forked wiping tip with wiping surfaces separated by recessed land portions. The wiper wicks ink from one nozzle and drags it along the linear array to other nozzles to lubricate the pen face and to dissolve any accumulated ink residue. Any ink rolls escape through the wiping tip recessed lands and move away from the nozzles. An optional wiper scraping system pivots through cammed engagement with the tumbler to selectively engage and scrape the wipers. A method is also provided of cleaning an inkjet printhead to maintain pen health, particularly for pens using fast drying pigment based inks.

23 Claims, 12 Drawing Sheets

U.S. PATENT DOCUMENTS

| | | | |
|---|---|---|---|
| 4,937,595 | 6/1990 | Midorikawa | 346/140 R |
| 4,982,199 | 1/1991 | Dunn | 347/15 |
| 5,081,472 | 1/1992 | Fisher | 346/140 |
| 5,103,244 | 4/1992 | Gast et al. | 346/1.1 |
| 5,115,250 | 5/1992 | Harmon et al. | 346/1.1 |
| 5,138,343 | 8/1992 | Aichi et al. | 346/140 R |
| 5,151,715 | 9/1992 | Ward et al. | 347/33 |
| 5,155,497 | 10/1992 | Martin et al. | 346/1.1 |
| 5,300,958 | 4/1994 | Burke et al. | 346/140 R |
| 5,339,098 | 8/1994 | Nagatomo et al. | 347/5 |
| 5,396,271 | 3/1995 | Premnath | 347/59 |
| 5,448,270 | 9/1995 | Osborne | 347/29 |
| 5,489,927 | 2/1996 | Harmon | 347/33 |
| 5,614,930 | 3/1997 | Osborne et al. | 347/33 |
| 5,689,293 | 11/1997 | Hirano | 347/33 |

FIG. 7
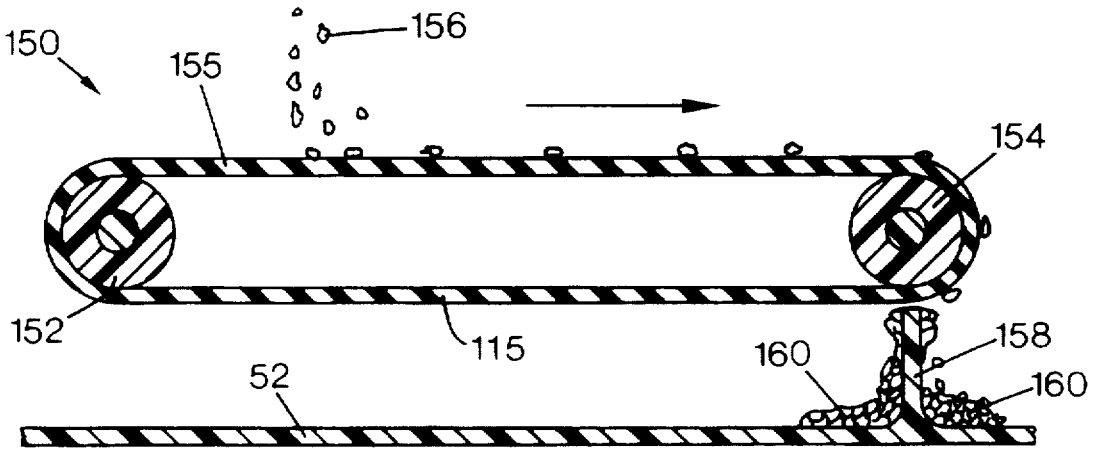
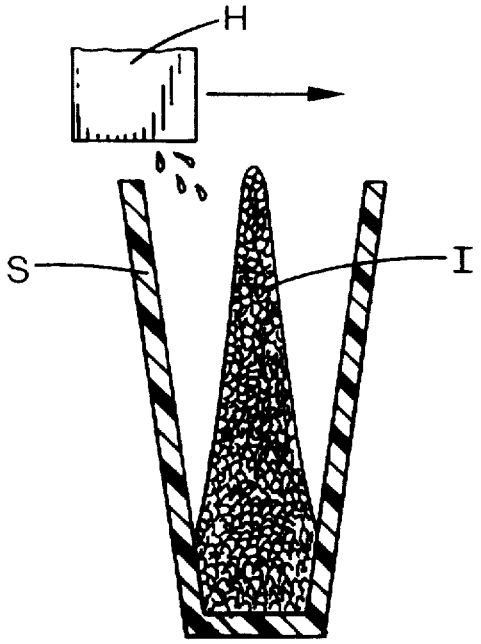
FIG. 8
PRIOR ART

ORTHOGONAL ROTARY WIPING SYSTEM FOR INKJET PRINTHEADS

CROSS REFERENCE TO RELATED APPLICATIONS

This is a continuation of application Ser. No. 08/330,461 filed on Oct. 28, 1994, now U.S. Pat. No. 5,614,930, which is a continuation-in-part application of the pending U.S. patent application Ser. No. 08/218,391, filed on Mar. 25, 1994, now U.S. Pat. No. 5,617,124 which has at least one inventor in common herewith.

FIELD OF THE INVENTION

The present invention relates generally to inkjet printing mechanisms, and more particularly to an improved rotary servicing system, including a method and apparatus, for cleaning inkjet printheads.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead moves back and forth across the page shooting drops as it moves. To clean and protect the printhead, typically a service station is mounted within the printer chassis. For storage, or during non-printing periods, service stations usually include a capping system which seals the printhead nozzles from contaminants and drying. Some caps are also designed to facilitate priming, such as by being connected to a pumping unit that draws a vacuum on the printhead.

During operation, clogs in the printhead are periodically cleared by firing a number of drops of ink through each of the nozzles in a process known as "spitting." Typically, the waste ink is collected in a stationary reservoir portion of the service station, which is often referred to as a "spittoon." After spitting, uncapping, or occasionally during printing, most service stations have an elastomeric wiper that wipes the printhead surface to remove ink residue, as well as any paper dust or other debris that has collected on the printhead.

To improve the clarity and contrast of the printed image, recent research has focused on improving the ink itself. To provide faster, more waterfast printing with darker blacks and more vivid colors, pigment based inks have been developed. These pigment based inks have a higher solid content than the earlier dye based inks, which results in a higher optical density, increased media independence and other advantages for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves.

Partially or completely blocked nozzles can lead to either missing or misdirected drops on the print media, either of which degrades the print quality. Thus, spitting to clear the nozzles becomes even more important when using pigment based inks, because the higher solids content contributes to the clogging problem more than the earlier dye based inks. Unfortunately, while stationary spittoons were suitable for the earlier dye based inks, they suffer a variety of drawbacks when used with newly developed pigment based inks.

For example, FIG. 8, is a vertical sectional view of a conventional prior art spittoon S which has been receiving waste ink of the newer variety for a period of time. The rapidly solidifying waste ink has gradually accumulated into a stalagmite I. The ink stalagmite I may eventually grow to contact the printhead H, which could interfere with printhead movement, print quality, and/or contribute to clogging the nozzles. Indeed, ink deposits along the sides of the spittoon often grow into stalagmites which can meet one another to form a bridge blocking the entrance to the spittoon. To avoid this phenomenon, conventional spittoons must be wide, often over 8 mm in width to handle these new pigment based inks. This extra width increases the overall printer width, resulting in additional cost being added to the printer, both in material and shipping costs.

This stalagmite problem is particularly acute for a polymer or wax based ink, such as an ink based on carnauba wax, or a polyamide. In the past, inkjet printers using polyamide based inks have replaced the conventional spittoon of FIG. 8 with a sheet of flat plastic. The nozzles are periodically cleared by "spitting" the hot wax ink onto the plastic sheet. At regular intervals, an operator must remove this plastic sheet from the printer, flex the sheet over a trash can to remove the waste ink, and then replace the cleaned sheet in the printer. This cleaning step is particularly inconvenient for operators to perform on a regular basis, and is not suitable for the new pigment ink. In comparison to the wax or polymer based inks, these new inks leave a waste which is quite dirty, due to the high amount of solids used to improve the contrast and quality of the printed images, and due to a non-evaporable liquid fraction. Thus, operator intervention to regularly clean a pigmented ink spittoon could lead to costly staining of clothing, carpeting, upholstery and the like.

Besides increasing the solid content, mutually precipitating inks have been developed to enhance color contrasts. For example, one type of color ink causes black ink solids to precipitate out of solution. This precipitation quickly fixes the black solids to the page, which prevents bleeding of the black solids into the color regions of the printed image. Unfortunately, if the mutually precipitating color and black inks are mixed together in a conventional spittoon, they do not flow toward a drain or absorbent material. Instead, once mixed, the black and color inks instantly coagulate into a gel, with some residual liquid being formed.

Thus, the mixed black and color inks have the drawbacks of hot-melt inks, which have an instant solid build-up, and the aqueous inks, which tend to run and "wick" (flow through capillary action) into undesirable locations. To resolve the mixing problem, two conventional stationary spittoons are required, one for the black ink and one for the color inks. As mentioned above, these conventional spittoons must be wide to avoid clogging from stalagmites growing inward from the spittoon sides. Moreover, using two spittoons further increases the overall width of the printer, which undesirably adds to the overall size of the inkjet printer, as well as its weight and material cost to build.

Ink aerosol generation is another problem encountered in inkjet pens. The aerosol problem can be especially severe with pigment based inks at high resolutions, such as those on the order of 600 dpi (dots per inch). Ink aerosol or satellites are micron-sized airborne ink particles, which are generated every time the printhead ejects an ink droplet, both during printing and spitting. Unfortunately, the new inks may need more spitting Than dye based inks to refresh the nozzles, due in part to the higher resolutions and the higher solids content of the new inks. Thus, there are more opportunities to generate aerosol when using the new pigmented inks.

The small size and mass of these aerosol particles allows them to float in the air, migrating to settle in a variety of undesirable locations, including surfaces inside the printer. Motion of the printhead carriage generates air currents that may carry the ink aerosol onto critical components, such as the carriage position encoder optics or the encoder strip. Aerosol fogging of the encoder components may cause opacity, as well as light scattering or refraction, resulting in the loss of carriage position information. This migrating ink aerosol may also increasing friction and cause corrosion of moving components, as well as degrading the life of critical components. For example, ink aerosol may accumulate along the printhead carriage guide rod, decreasing bushing life and increasing friction during normal operation.

Worse yet, this aerosol may settle on work surfaces near the printer, where it can then be transferred to an operator's fingers, clothing or other nearby objects. When the pen fires to print an image, many of these extraneous aerosol droplets land on the page, rather than floating around inside the printer. Unfortunately, these extraneous droplets then degrade print quality. Efforts to improve reliability have also contributed to the aerosol problem. For example, low evaporation rate solvents have been employed to address the nozzle clogging problem discussed above. Unfortunately, these solvents cause the aerosol droplets to dry very slowly, if at all, once deposited inside the printer.

New wiping strategies are needed for the pigment based inks to maintain a high print quality in the hardcopy image output. Besides the problems encountered in spitting, new challenges have also arisen in wiping these new inks from the printheads. To maintain the desired ink drop size and trajectory, the area around the printhead nozzles must be kept reasonably clean. Dried ink and paper fibers are known to stick to the nozzle plate, which causes print quality defects if not removed. Wiping the nozzle plate removes excess ink and other residue accumulated along the pen face.

In the past, the printhead wipers have been a single or dual wiper blade made of an elastomeric material. Typically, the printhead is translated across the wiper in a direction parallel to the scan axis of the printhead. In one printer, the wipers were rotated about an axis perpendicular to the printhead scan axis to wipe. Today, most inkjet pens have nozzles aligned in two linear arrays which run perpendicular to the scanning axis. Using these earlier wiping methods, first one row of nozzles was wiped and then the other row was wiped. While these earlier wiping methods proved satisfactory for the traditional dye based inks and for slower drying pigment inks, unfortunately, they are unacceptable for the newer fast drying pigment inks.

In using the fast drying pigment based inks, three primary failure modes were discovered using traditional wipers. First, the ink dries out, and then sticks tightly to the nozzle plate with such a force that a traditional wiper cannot move the ink, even through the use of high force wipers. Unfortunately, high force wipers risk damaging the printhead, and they require a heavier base structure to support the wiper. In the second failure mode, dried ink particles occasionally broke loose and were then rolled up by the wiper. Unfortunately, these ink rolls often settled over a nozzle, causing a partial or total blockage interrupting ink ejection. In the third failure mode, the ink would dry out in layers around a nozzle in a shape resembling a volcano caldera, which then caused drop trajectory problems. Traditional wipers were not able to effectively remove the dry ink down to the caldera base, which resulted in formation of caldera over time.

SUMMARY OF THE INVENTION

According to one aspect of the invention, a service station is provided for servicing an inkjet printhead of an inkjet printing mechanism, with the printhead having a face plate defining a group of ink ejecting nozzles extending therethrough in a linear array. The service station includes a platform moveable in a wiping direction. The service station also has a printhead wiper supported by the platform to wipe the face plate parallel to the linear nozzle array when the platform is moved in the wiping direction.

In another embodiment, a service station is provided for servicing an inkjet printhead that traverses along a scanning axis of an inkjet printing mechanism. This service station includes a tumbler body supported to pivot about a first axis substantially parallel to the scanning axis. The service station also has a printhead wiper supported by the tumbler body to wipe the printhead during pivotal movement of the tumbler body.

In a further embodiment, a service station includes a platform moveable in a wiping direction, with a printhead wiper supported by the platform to wipe the printhead when the platform is moved in the wiping direction. This service station also has a scraper moveable into a scraping position to engage and scrape ink residue from the wiper.

In an illustrated embodiment, a printhead wiper is provided for wiping an inkjet printhead. The wiper includes a base which is mountable to the inkjet printing mechanism, for example, using a tumbler assembly. The wiper also has a pair of spaced apart wiper blades projecting from the base to selectively engage and wipe the printhead, with each blade terminating in a wiping tip having a rounded edge. Preferably, the wiping tip of each blade has an angular edge, or more preferably a square edge, opposite the rounded edge.

According to another aspect of the present invention, a method is provided of wiping an inkjet printhead of an inkjet printing mechanism, where the printhead has a face plate defining a group of ink ejecting nozzles extending therethrough in a linear array. The method includes the step of positioning a wiper to engage the face plate. In a wiping step, the face plate is wiped through relative motion of the wiper and face plate along the length of the linear nozzle array.

In another embodiment, a method is provided of wiping an inkjet printhead that has a face plate defining at least two adjacent ink ejecting nozzles extending therethrough. This method includes the step of wiping the face plate through relative motion of a wiper and the face plate. In an extracting step, ink is extracted from one nozzle through capillary action during the wiping step. In a moving step, the extracted ink is moved along the face plate with the wiper. In an illustrated embodiment, the moving step comprises the step of lubricating the face plate using the extracted ink. In another embodiment, the moving step comprises the steps of moving the extracted ink to another nozzle, and dissolving ink residue adjacent this other nozzle using the extracted ink.

In a further embodiment, a method is provided of wiping an inkjet printhead that traverses along a scanning axis of an inkjet printing mechanism. The method includes the step of positioning the printhead to be engaged by a wiper. In a rotating step, the wiper is rotated about a first axis substantially parallel to the scanning axis to wipe the printhead.

Another aspect of the present invention addresses the inkjet aerosol problem by providing a method of controlling airborne ink aerosol generated by ejecting ink from an inkjet printhead. The method includes the steps of rotating a cylindrical or annular spittoon about a first axis to receive ink purged from the printhead. The close proximity of the rotating spittoon to the source of ejected floating droplets provides a convenient landing surface for the aerosol droplets to settle upon. These spittoon landing surfaces are preferably easily cleaned, such as by a spittoon scraper, to remove the accumulated ink droplets.

According to another aspect of the present invention, a method is provided of recovering normal operation of a inkjet printhead which has a face plate defining a group of ink ejecting nozzles extending therethrough arranged in a linear array, with at least some of the nozzles having crusted ink formed therein to obstruct normal operation. This recovery method includes the step of slow wiping the face plate through relative motion of a wiper and the face plate along the length of the linear nozzle array to extract ink through capillary action from one nozzle, and to move the extracted ink along the face plate with the wiper. In a scraping step, ink residue is scraped from the wiper after the slow wiping step. The method also includes the step of fast wiping the face plate through relative motion of the wiper and face plate along the length of the linear nozzle array. Preferably, the wiper is scraped after each wiping cycle.

According to yet another aspect of the present invention, a method is provided of wiping an inkjet printhead which includes the step of wiping the face plate through relative motion of a wiper and the face plate. In a moving step, a scraper is moved into a scraping position to engage the wiper. After the wiping step, the ink residue is scraped from the wiper using the scraper. In an illustrated embodiment, the moving step comprises the step of pivoting the scraper into the scraping position in response to motion of the wiper. In another illustrated embodiment, the method further includes the steps of draining liquid ink residue away from the scraper after starting the scraping step, and absorbing the drained liquid ink residue into an absorbent member.

An overall object of the present invention is to provide an inkjet printing mechanism which prints sharp vivid images, and which more preferably does so using a fast drying pigment based ink, as well as dye based inks.

Another object of the present invention is to provide a service station for an inkjet printing mechanism which maintains pen health, is substantially self-cleaning, and occupies a relatively small physical space to provide a more compact product.

A further object of the present invention is to provide a method of cleaning an inkjet pen mounted in a printing mechanism during operation.

BRIEF DESCRIPTION OF THE DRAWINGS

FIG. 7 is a side elevational view of a third embodiment of a self-cleaning service station of the present invention.

FIG. 8 is a side elevational view of a conventional spittoon portion of a prior art service station.

DETAILED DESCRIPTION OF THE PREFERRED EMBODIMENTS

Figure 1:
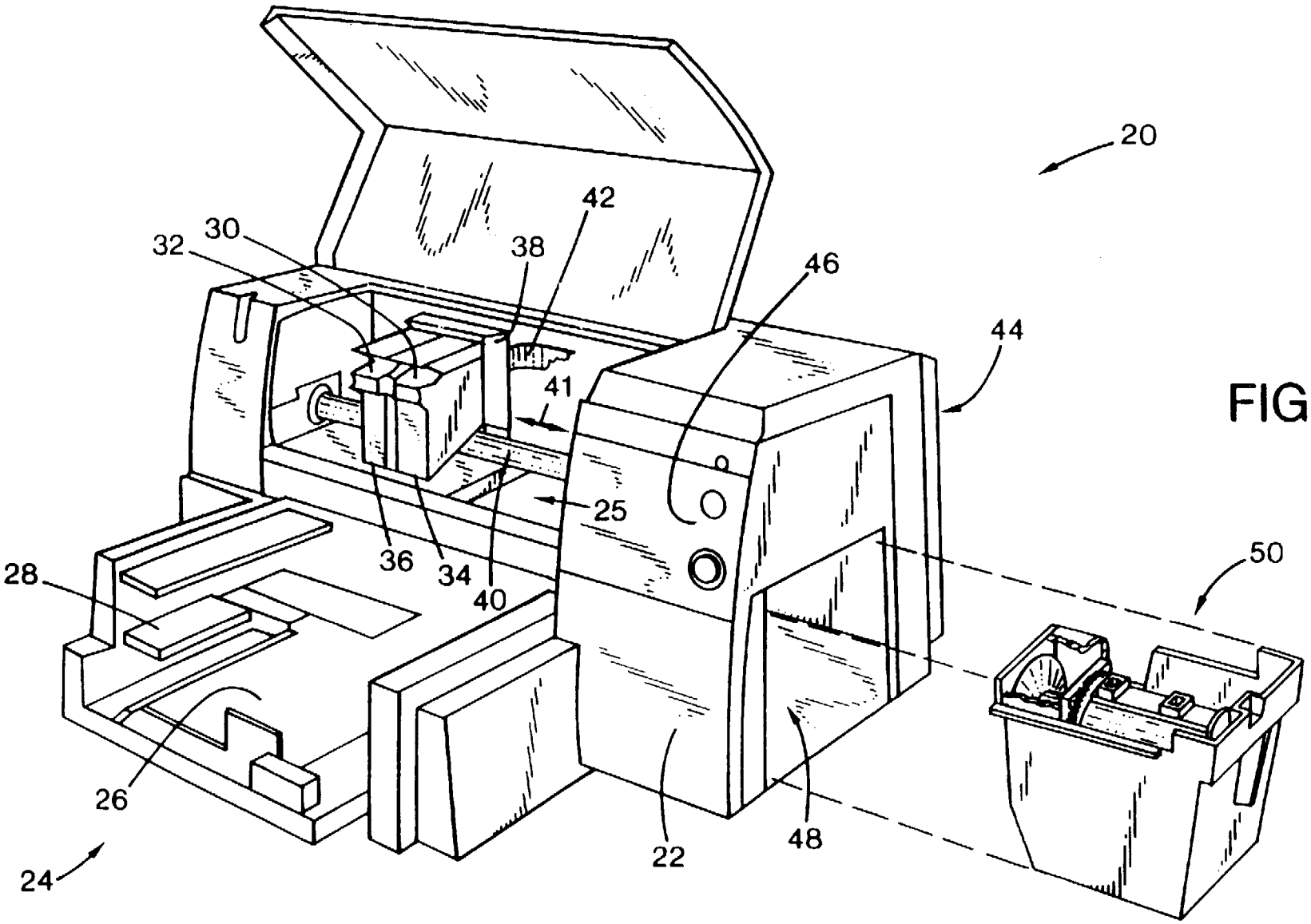
FIG. 1 is a perspective view of one form of an inkjet printing mechanism of the present invention incorporating a first embodiment of a self-cleaning service station of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 and a print medium handling system 24 for supplying sheets of print media to the printer 20. The print media may be any type of suitable sheet material, such as paper, card-stock, transparencies, mylar, foils, and the like, but for convenience, the illustrated embodiment is described using paper as the print medium. The print medium handling system 24 moves the print media into a print zone 25 from a feed tray 26 to an output tray 28, for instance using a series of conventional motor-driven rollers (not shown).

In the print zone 25, the media sheets receive ink from an inkjet cartridge, such as a black ink cartridge 30 and/or a color ink cartridge 32. The cartridges 30, 32 are also referred to as "pens" by those in the art. The illustrated color pen 32 is a tri-color pen, although in some embodiments, a group of discrete monochrome pens may be used, or a single monochrome black pen 30 may be used. While the color pen 32 may contain a pigment based ink, for the purposes of illustration, pen 32 is described as containing three dye based ink colors, such as cyan, yellow and magenta. The black ink pen 30 is illustrated herein as containing a pigment based ink. It is apparent that other types of inks may also be used in pens 30, 32, such as paraffin based inks, as well as hybrid or composite inks having both dye and pigment characteristics.

The illustrated cartridges or pens 30, 32 each include reservoirs for storing a supply of ink therein, although other ink supply storage arrangements, such as those having reservoirs (not shown) mounted along the chassis may also be used. The cartridges 30, 32 have printheads 34, 36 respectively. Each printhead 34, 36 has a bottom surface comprising an orifice plate with a plurality of nozzles formed therethrough (see FIG. 18) in a manner well known to those skilled in the art. The illustrated printheads 34, 36 are thermal inkjet printheads, although other types of printheads may be used, such as piezoelectric printheads. The printheads 34, 36 typically include a plurality of resistors which are associated with the nozzles. Upon energizing a selected resistor, a bubble of gas is formed ejecting a droplet of ink from the nozzle and onto a sheet of paper in the print zone 25 under the nozzle.

The cartridges or pens 30, 32 are transported by a carriage 38 which may be driven by a conventional drive belt/pulley and motor arrangement (not shown) along a guide rod 40. The guide rod 40 defines a scanning direction or scanning axis 41 along which the pens 30, 32 traverse over the print zone 25. The pens 30, 32 selectively deposit one or more ink droplets on a print media page located in the print zone 25 in accordance with instructions received via a conductor strip 42 from a printer controller, such as a microprocessor which may be located within chassis 22 at the area indicated generally by arrow 44. The controller 44 may receive an instruction signal from a host device, which is typically a computer, such as a personal computer. The printhead carriage motor and the paper handling system drive motor operate in response to the printer controller 44, which may operate in a manner well known to those skilled in the art. The printer controller may also operate in response to user inputs provided through a key pad 46. A monitor coupled to the host computer may be used to display visual information to an operator, such as the printer status or a particular program being run on the computer. Personal computers, their input devices, such as a keyboard and/or a mouse device, and monitors are all well known to those skilled in the art.

Figure 2:
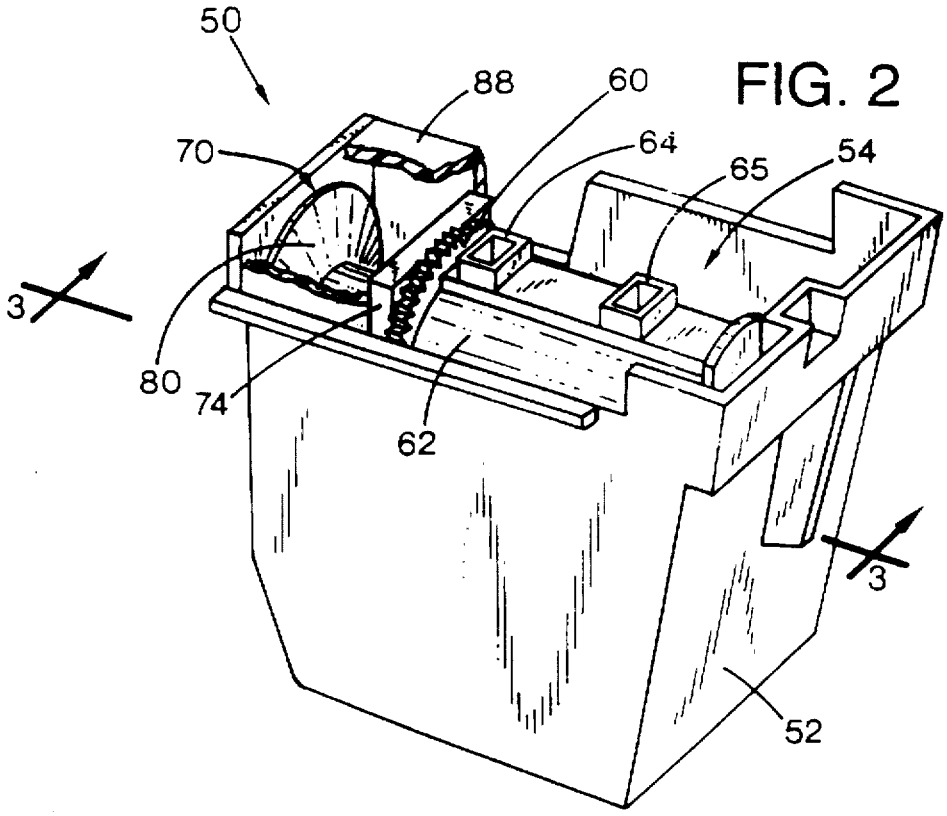
FIG. 2 is a perspective view of the self-cleaning service station of FIG. 1.
Figure 3:
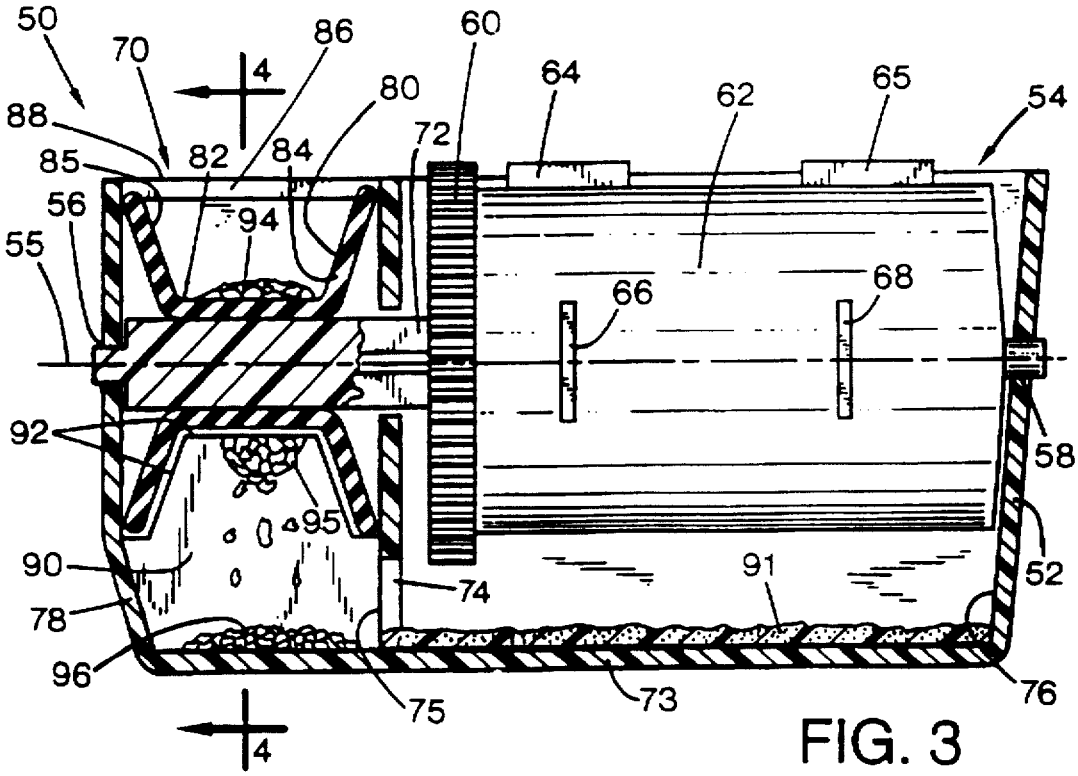
FIG. 3 is a front vertical elevational view taken along lines 3—3 of FIG. 2.
Figure 4:
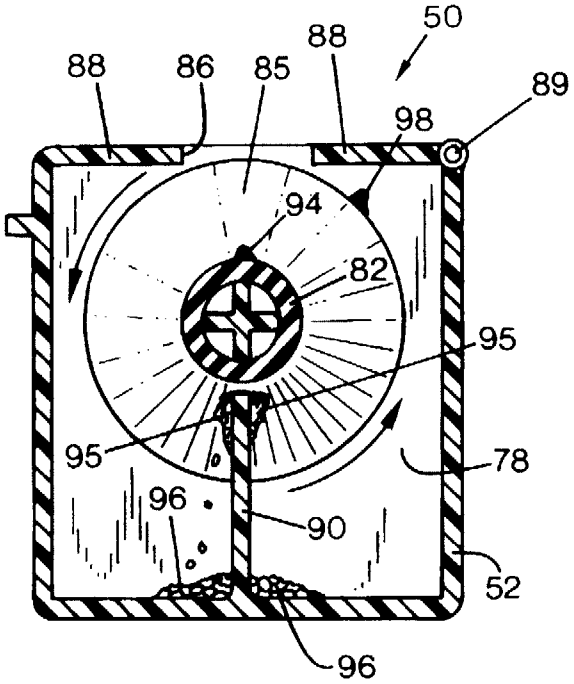
FIG. 4 is a side elevational view taken along lines 4—4 of FIG. 3.

Referring also to FIGS. 2–4, the printer chassis 22 has a chamber 48, configured to receive a service station 50, located at one end of the travel path of carriage 38. Preferably, the service station 50 is constructed as a modular device capable of being unitarily inserted into the printer 20, to enhance ease of initial assembly, as well as maintenance and repair in the field. The illustrated service station 50 has a frame 52 which may be slidably received within chamber 48 the printer chassis 22. However, it is apparent that the service station 50 may also be constructed with the station frame 52 integrally formed within the chassis 22.

The service station 50 has a tumbler portion 54 mounted to frame 52 for rotation about a first axis or tumbler axis 55 with bearings 56, 58. The tumbler axis 55 is substantially parallel to the printhead scanning axis 41. The tumbler 54 may be driven by motor and gear or belt assembly (not shown), or through a separate motor (not shown) via a gear 60. The tumbler 54 includes a main body 62 upon which may be mounted conventional inkjet pen caps, such as a color ink cap 64 and a black cap 65. The body 62 also supports color and black ink wipers 66 and 68 for wiping the respective color and black printheads 36, 34. Other functions may also be provided on the main body 62, such as primers and the like, which are known to those skilled in the art. It is apparent that other arrangements may be used to index the pen capping, wiping, etc. Function rather than the tumbler main body 62. For example gears or linkages (not shown) known to those skilled in the art may be used for selectively engaging the service station equipment 64, 65 and 66, 68 with the respective printheads 36, 34. However, the tumbler concept illustrated in FIGS. 1–4 is preferred because of its ease of implementation and adaptability for modular use.

Self-Cleaning Service Station—First Embodiment

FIGS. 1–4 illustrate the first embodiment of the self-cleaning service station 50 as having a rotating annular trough or "ferris wheel" spittoon 70. The spittoon 70 receives ink which is spit from the black ink and color pens 30, 32 when they are positioned above the spittoon. The spittoon 70 is driven by gear 60 via a roller, spindle or axle portion 72, which extends from the main body 62. The frame structure 52 has a bottom wall 73 and an intermediate wall 74. The wall 74 separates the service station 50 into a spittoon chamber 75 and a main servicing chamber 76. As shown in FIG. 3, the spittoon chamber 75 is located between wall 74 and an outer wall 78 of the frame 52.

The ferris wheel spittoon 70 has a moveable platform provided by an annular trough or "ferris wheel" 80. The wheel 80 has an annular bottom portion 82 and two side walls 84, 85, and is mounted to the axle 72 for rotation about the tumbler axis 55. The wheel 80 receives ink purged from the printheads 34 and 36 through an opening 86. The opening 86 is defined by an upper wall or lid 88, which may be a portion of, or pivoted at a hinge 89 to, the frame 52. Preferably, the wheel 80 is of an elastomeric or other resilient and flexible material, such as neoprene or nitrile rubber, or other comparable materials known in the art. More preferably the wheel 80 is of ethylene polypropylene diene monomer (EPDM). The use of an elastomeric material is preferred to facilitate sealing the area between the wheel side walls 84, 86 and the frame walls 74 and 78, respectively. However, it is apparent that other types of material may also be used for wheel 80, such as various plastics which are flexible and resilient to provide a positive seal between the wheel 80 and walls of frame 52.

The spittoon 70 also has a scraper portion 90 for removing purged ink from the ferris wheel 80, as shown in FIG. 3. Adjacent the scraper 90, the main servicing chamber 76 may be lined with a liquid absorbent diaper 91, which may be of a felt, pressboard, sponge or other material. The diaper 91 absorbs liquids spit from the pens 30, 32. When both black and color inks are deposited in the spittoon 70, once mixed, these inks instantly coagulate into a gel, with some residual liquid being formed. This residual liquid may also be absorbed by the diaper 91.

In the illustrated embodiment, the scraper 90 is of a substantially rigid plastic material. The scraper 90 may be molded unitarily with the remaining portion of frame 52 for convenience, although it is apparent that the scraper 90 may be separately assembled into frame 52. The scraper portion 90 preferably has a scraping surface 92 conformed to roughly approximate the cross-sectional shape of the wheel 80, as shown in FIG. 3.

In operation, referring to FIGS. 3–4, recently spit ink 94 is collected along the wheel bottom surface 82. The tumbler 54 is rotated via a gear assembly (not shown) in contact with gear 60 until the majority of the discharged ink 94 is removed from roller 80 by scraper 90. An accumulation of recently removed ink 95 may accumulate adjacent the upper edge 92 of the scraper 90. Eventually, this accumulated ink 94 will dry and fall from the scraper to form piles of dried ink solids 96 at the bottom of the spittoon chamber 75. Ink may also accumulate along the rim surface of the ferris wheel side walls 84, 85, such as ink accumulation 98 shown in FIG. 4. Advantageously, by selecting a relatively close spacing between the lid 88 and the walls 84, 85, the lid 88 scrapes the ink solids 98 from the wheel rims to prevent the solids 98 from touching the printheads 34, 36. As mentioned in the background portion, if left unattended, such ink residue 98 could contact the nozzle plate, potentially damaging or clogging the orifices of the printheads 34, 36.

Self-Cleaning Service Station—Second Embodiment

Figure 6:
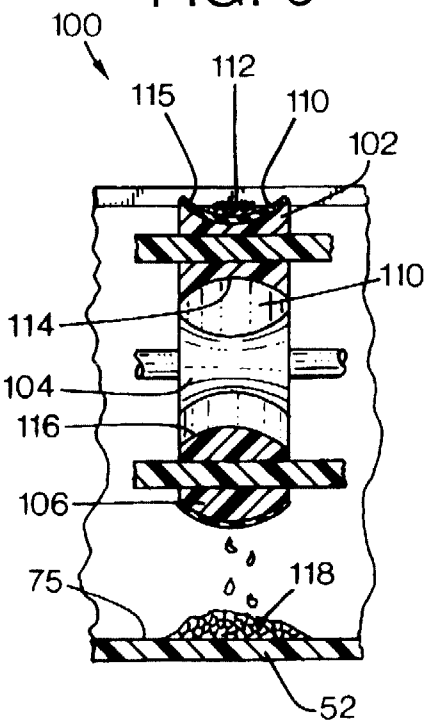
FIG. 6 is a front elevational view taken along lines 6—6 of FIG. 5.
Figure 5:
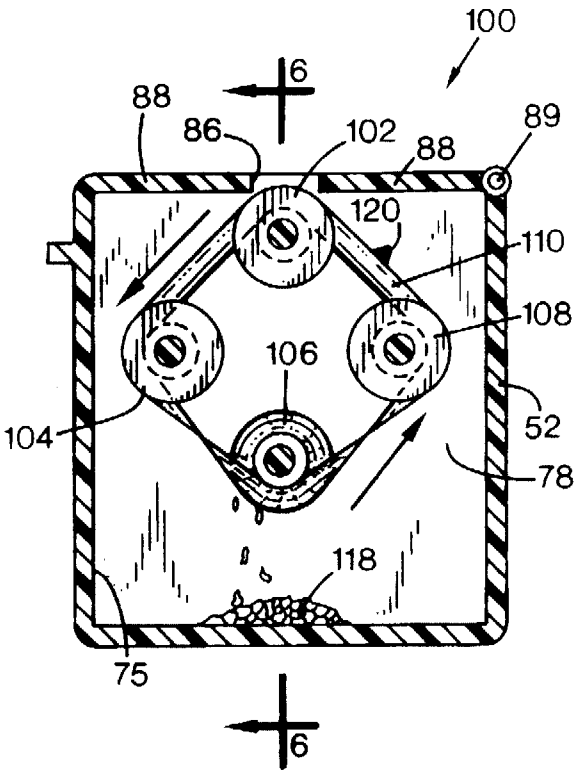
FIG. 5 is a side elevational view of a second embodiment of a self-cleaning service station of the present invention.

FIGS. 5 and 6 illustrate a second alternate embodiment of an inkjet spittoon 100 constructed in accordance with the present invention, which may be substituted for the ferris wheel spittoon 70 of FIGS. 1–4. The spittoon 100 comprises a multiroller spittoon having two or more rollers, here, having four rollers 102, 104, 106 and 108. One of the rollers 102–108 may be driven by gear 60 and the remaining rollers may be mounted between walls 74 and 78 for free pivoting. The rollers 102–108 support an a moving platform comprising an endless belt 110, which may be constructed of an elastomer, polymer, plastic, fabric, or other flexible material.

In the spittoon 100, the mechanism for removing recently spit ink 112 from belt 110 comprises an ink removal device formed by the contours of rollers 102 and 106, rather than through the use of a scraper 90. In the illustrated embodiments, the roller 102 is positioned under opening 86 in the lid 88. The roller 102 has a concave surface 114 which forms a trough 115 in belt 110 for receiving the ink 112. To expel the ink 112 from belt 110, the lower roller 106 has a convex surface 116 which flexes the belt 110 outwardly to dump the spent ink solids 112 into a refuse ink pile 118 along the lower surface of the spittoon chamber 75. Any residual liquid ink drains to the lowest point of the convex surface 116 before dropping off the belt 110. Rollers 104 and 108 may be cylindrical or have configurations which are either concave or convex, but as illustrated, roller 104 is concave and roller 108 is convex. Furthermore, it is apparent that a scraper mechanism, such as scraper 90, may also be used in conjunction with the contoured rollers 102, 106 to remove ink deposits from the belt 110. The rim of roller 102, thickness and width of belt 110, and the relative location of lid 88 to the edges of belt 110 may be selected to remove ink accumulations 120 from the belt edges, as described above with respect to FIG. 4 for the rim accumulation 98.

Self-Cleaning Service Station—Third Embodiment

A third embodiment of a self-cleaning spittoon 150 is shown in cross-section in FIG. 7. The spittoon 150 may include two or more rollers, such as roller 152 and 154 which are coupled together by an endless belt 155. Preferably, roller 152 may be coupled to the tumbler portion 54 to be driven by gear 60. In the illustrated embodiment, roller 152 is positioned below the frame lid opening (not shown) in the frame lid 88 to receive the ink 156 from printheads 34, 36. The ink 156 travels along the upper surface of belt 155, and around roller 154 where it encounters a scraper 158, and is scraped off as ink solids 160. Alternatively, the illustrated cylindrical rollers 152 and 152 may be replaced with concave and convex rollers, such as roller 102 and 106, respectively of FIGS. 5 and 6. In such an embodiment, the scraper 160 may be used in conjunction with roller 154 having a convex shape, or the scraper 160 may be omitted in such a contoured roller embodiment. The belt 155 may be as described above with respect to belt 110 regarding flexing.

One advantage of the spittoon embodiment 150 is that it receives ink in one portion of the printer adjacent roller 152, and expels the dried solids in a remote location adjacent roller 154. While the belt 155 is illustrated as being a substantially flat belt, it is apparent that it may be flexible to conform to the contours of rollers as described above with respect to FIGS. 5–6, or it may have side walls similar to walls 84 and 86 (FIG. 3).

Method of Purging an Inkjet Pen

According to another aspect of the illustrated embodiment, a method is also provided for cleaning an inkjet pen, such as pen 30 or 32, when mounted for use in an inkjet printer, such as printer 20. The method includes the steps of positioning the pen 30 or 32 over a moveable platform surface of the service station 70. This moveable platform may be provided by the ferris wheel 80, or belts 110 or 155. A portion of the ink is purged from the pen 30 or 32 onto the platform. The platform is then moved to a discharge location, illustrated here with the platforms being driven by rotating gear 60 or the at least one of the rollers 102–108 and 152–154. The discharge location is illustrated as adjacent scraper 90 (FIGS. 3–4), adjacent roller 106 (FIGS. 5–6), and adjacent roller 154 and scraper 158, if used (FIG. 7).

In a discharging step, the purged waste ink is discharged from the platform surface at the discharge location. As shown in FIGS. 3–4, the discharging is illustrated by scraper 90 scraping ink off of the ferris wheel 80. In FIGS. 5–6, discharging is accomplished by flexing the belt 110 using the convex contour 116 of roller 106. In FIG. 7, the scraper 158 provides the discharge mechanism, in addition to, or as an alternative to a convex profile for roller 154. That is, the contoured roller concept may be combined with the scraper concept (not shown) by forming the scraper upper surface (item 92 in FIG. 3) with a concave contour to compliment the convex contour of roller 106, for instance.

Advantages of the Self-Cleaning Service Station

Thus, a variety of advantages are achieved using the movable platform spittoon of the present invention, for example in the various embodiments as illustrated in FIGS. 1–7. For instance, ink no longer accumulates into a stalagmite I as shown in FIG. 8 for the earlier conventional spittoon S. Instead, the waste ink is transported from a receiving location to a discharge location where it is broken off in small pieces 96, 118, 160. During periodic servicing of the printer 20, these waste ink solids 96, 118, 160 may be easily removed, and they are more compact for disposal than the large stalagmites I encountered in the prior art (FIG. 8). Thus, the packing density of a pile of short stalagmites formed as shown in FIGS. 3–7 is much less than that for the large stalagmite I shown in FIG. 8.

Furthermore, the use of a moveable platform spittoon allows for the accumulation of a greater number of ink solids than achieved with the stationary spittoon S of FIG. 8. As a result, the printer 20 may be operated for longer periods of time between servicing to remove accumulated ink solids. Additionally, accumulation of the ink solids 95 will not inhibit printhead performance as would be the case for high ink solids using the earlier FIG. 8 stationary spittoon S.

Moreover, the illustrated spittoons of FIGS. 1–7 may have a very narrow width, e.g. narrow in the axial direction parallel with the tumbler axis 55. Indeed, the width of the ferris wheel 80, or the belt 110, 155 need only be as wide as the precision within which the ink may be spit into them, for instance, as small as 2 mm, as opposed to 8 mm for spittoon S of FIG. 8. Thus, a narrower service station may be achieved, which reduces the overall size of printer 20 to reduce material costs, shipping and packing costs, and to provide a more compact printer 20 for the consumer.

The use of an elastomeric or other resilient material for the ferris wheel 80 of FIGS. 1–4 provides additional advantages. For example, the aqueous residue from the expelled ink 94 tends to run downwardly under the force of gravity, and to wick along corners and edges of the spittoon chamber 75. The elastomeric rims 84 and 86 of wheel 80 advantageously provide a liquid seal against walls 74 and 78, respectively. Even if liquid is lifted from the bottom portion of the chamber 75 by the rims 84 and 85 upwardly toward the lid 88, the rim seals will prevent this liquid from reaching the remaining service station equipment of the main body 62. That is, the rim 84 seals the opening in wall 74 through which the shaft 72 passes. Advantageously, the caps 64 and 65, the wipers 66 and 68, and any other service station component mounted on the main body 62 are kept clean to maintain print quality.

Ink aerosol generation is another problem that is addressed by the ferris wheel spittoon system described herein. In comparison with the earlier spittoon designs, such as shown in FIG. 8, the droplet receiving surfaces of the spittoons shown in FIGS. 1–7 are much closer to the print cartridges 30, 32. Placing easily cleanable surfaces close to the printhead allows the small airborne ink particles to be intercepted and collected, rather than allowing the aerosol droplets to drift through the printer and land on other critical components. For example, the close proximity of the spittoon surfaces to the printheads, which are the source of floating droplets, provide convenient landing surfaces for the aerosol droplets to settle upon, such as the side walls 84 and 85 of the annular spittoon 70. These spittoon landing surfaces are easily cleaned by the spittoon scraper 90 to remove the accumulated aerosol ink droplets. Thus, print quality is enhanced by removing at least some of the extraneous aerosol droplets before they land on the print media. These captured satellites are then unable to damage printhead components through friction and corrosion, nor are they available to fog any optical encoder components cause loss of carriage position information. Eliminating a sizable portion of the aerosol also decreases soiling of an operator's fingers, clothing or other nearby objects.

Orthogonal Rotary Wiping System

Figure 9:
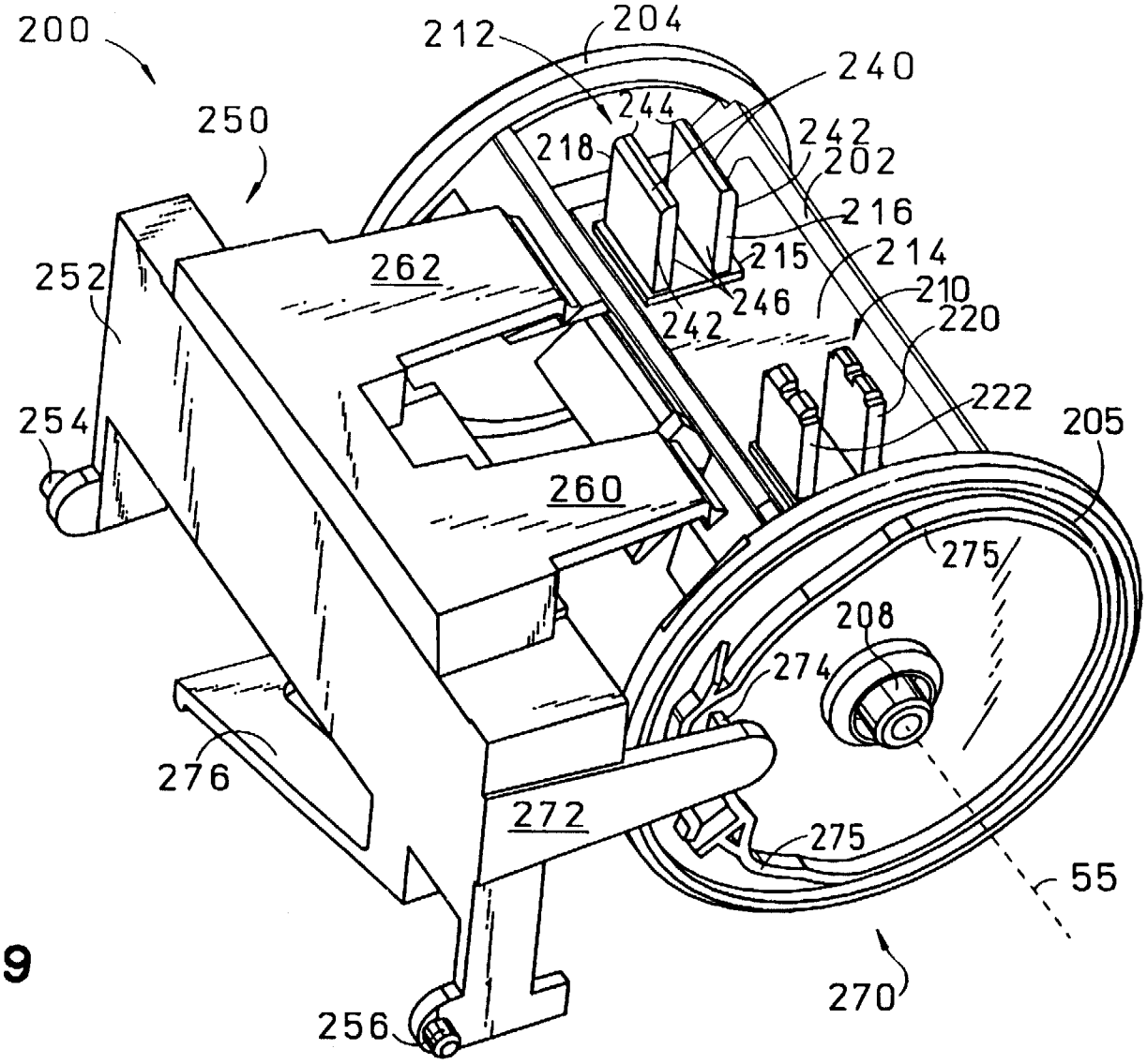
FIGS. 9 and 10 are perspective views from opposite sides of an alternate embodiment of a rotary wiping system portion and wiper scraping system portion of a service station of the present invention, shown removed from the service station frame, with FIG. 10 being a partially fragmented view.
Figure 10:
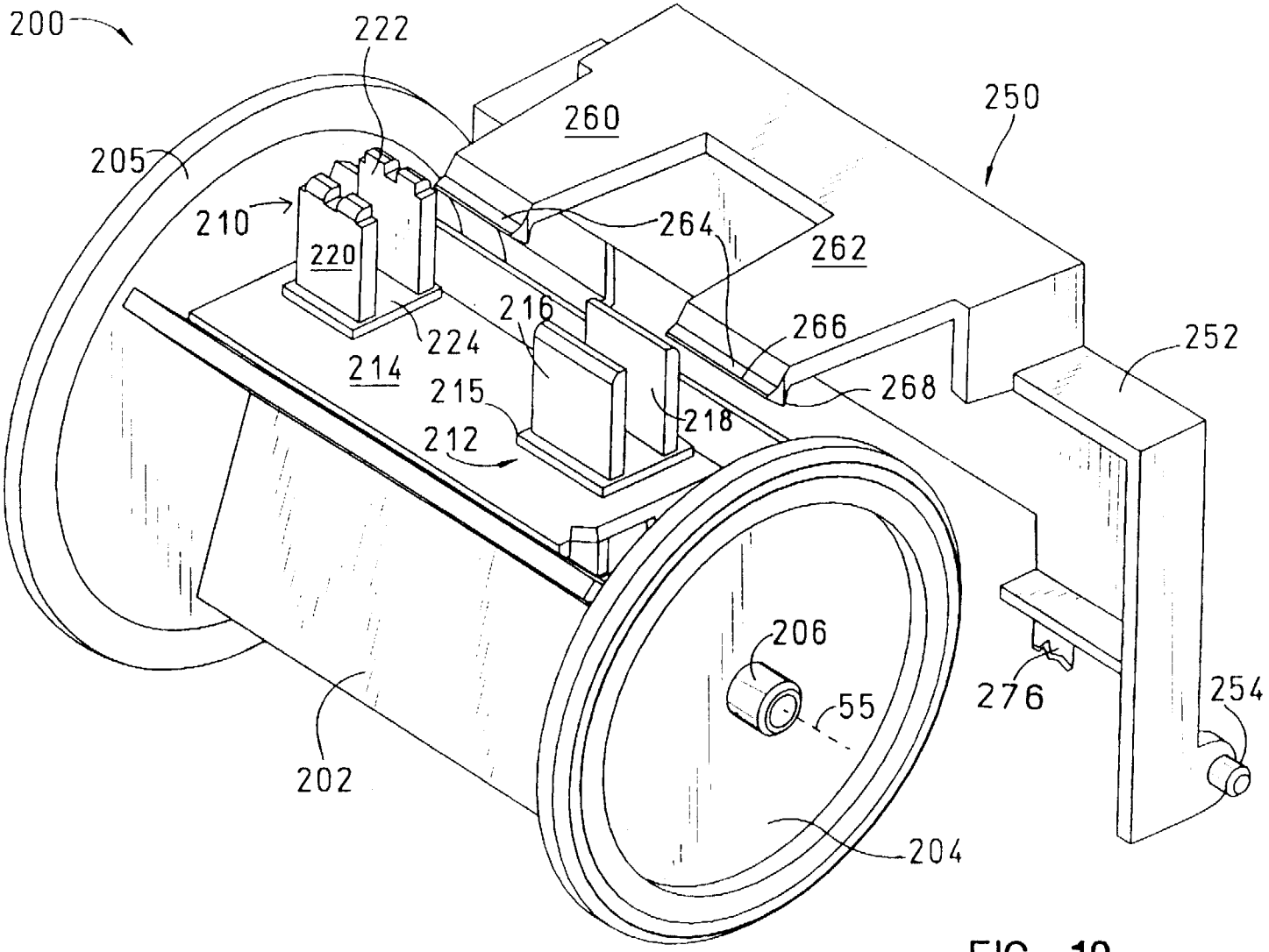

FIGS. 9 and 10 illustrate an alternate rotary service station 200 constructed in accordance with the present invention. The rotary service station 200 includes a tumbler body portion 202 which terminates at opposing axial ends with two wheel portions or rims 204 and 205. The tumbler body 202 may be mounted pivotally at hubs 206 and 208 within the service station frame 52 by bearing assemblies, such as bearing 58 shown in FIG. 3. In the illustrated embodiment, the hub 206 may engage the spindle portion 72 which extends through the ferris wheel 80. Alternatively, the service station wall 74 may be equipped with a bearing member similar to bearings 56 or 58, to receive hub 206, with the spindle 72 then engaging hub 206 for providing rotation about the tumbler axis 55. In either case, the outer periphery of the tumbler rim 204 preferably has gear teeth formed thereon to function as the drive gear 60, but for clarity, the gear teeth have been omitted from FIGS. 9 and 10. Alternatively, it is apparent that the rotary service station 200 may also be used with a conventional spittoon comprising one, two or more fixed spittoon chambers instead of the ferris wheel service station 80 shown in FIGS. 1–4.

The rotary station 200 may include a printhead capping mechanism, such as caps 64 and 65 shown in FIGS. 1–3, but which are omitted for clarity from FIGS. 9 and 10. The rotary service station 200 also has a black ink wiper 210 and a color ink wiper 212, both of which are supported by a mounting platform portion 214 of the tumbler body 202. The color wiper 212 may be of a substantially conventional construction, having a base portion 215 and one or, more preferably, two spaced apart upright blade portions 216 and 218, which are preferably mutually parallel. The base portion 215 may be joined to the platform 214 by any conventional manner, such as by bonding with adhesives, sonic welding, or more preferably by oncert or incert molding techniques, where a portion of the wiper base 215 extends through holes formed within platform 214. In the illustrated embodiment, wiper 212 of a non-abrasive resilient material, such as an elastomer or plastic, a nitrile rubber or other rubber-like material, but preferably is of an ethylene polypropylene diene monomer (EPDM), or other comparable materials known in the art. In the illustrated embodiment, the color wiper 212 is designed for wiping the color pen 32, which in the illustrated embodiment contains three dye based colored inks, such as cyan, magenta, and yellow.

Figure 11:
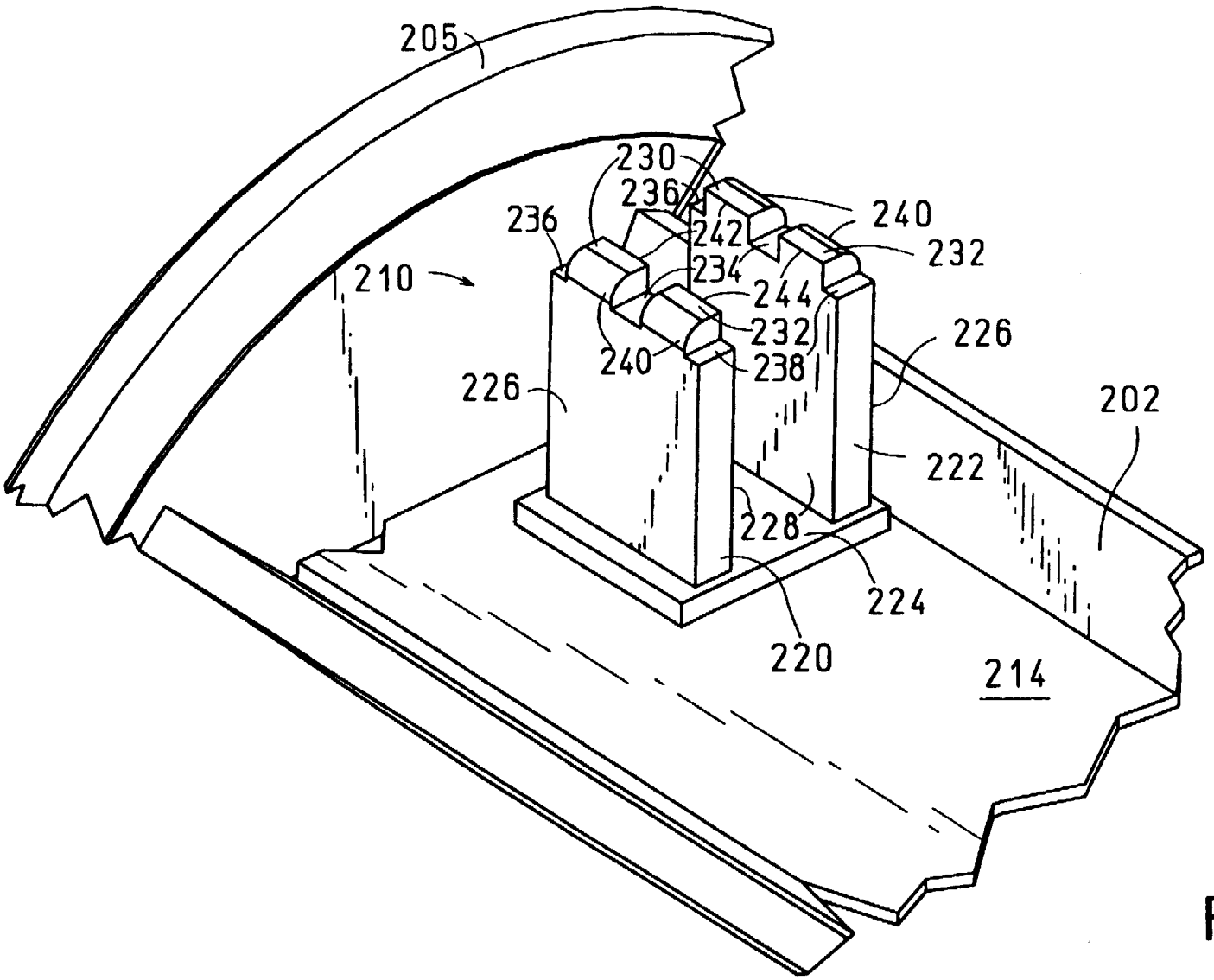
FIG. 11 is an enlarged perspective view of one wiper shown in FIGS. 9 and 10.

Referring to FIG. 11, the black ink wiper 210 is shown in greater detail. In the illustrated embodiment, the black pen 30 contains a pigment based ink which wiper 210 serves to wipe more efficiently than a conventional wiper. In the illustrated embodiment, the black ink wiper 210 includes two upright spaced apart blade portions 220 and 222, both mounted to a common base 224, preferably in a mutually parallel orientation. The black wiper 210 may be mounted to platform 214 in any of the manners described above for the color wiper 212. In the illustrated embodiment, the two blades 220, 222 each have an outboard surface 226 and an inboard surface 228.

Each of the black wiper blades 220 and 222 terminate in a wiping tip at their distal end. Preferably the wiping tips have a forked geometry, with the number of fork tongs equal to the number of linear nozzle arrays on the corresponding printhead, here fork two tongs for two linear nozzle arrays, as described further below with respect to FIG. 18. Thus, the wiper blades 220, 222 each have a pair of wiping surfaces 230, 232 which are separated by a recessed flat land portion 234. In the illustrated embodiment, each of the wiper tips 230, 232 are also flanked on their outboard sides by recessed flat land portions, 236, 238.

In the illustrated embodiment, both the color wiper blades 216, 218 and the wiper tips 230, 232 of the black blades 220, 222 each have an outboard rounded edge 240. The rounded wiping edge 240 is adjacent the outboard surfaces 226 of blades 220, 222, and adjacent outboard surfaces 242 of the color blades 216, 218. The rounded tips 240 assist in forming a capillary channel which is advantageous during wiping, as described further below. Opposite each rounded wiping edge 240, the wiping tips of blades 216, 218, 220, 222 may terminate angularly, or more preferably, in a square edge 244. The angular wiping edge 244 is adjacent the inboard surfaces 228 of blades 220, 222, and adjacent inboard surfaces 246 of the color blades 216, 218.

In the illustrated embodiment, an optional wiper scraping system 250 is included in the rotary service station 200. The scraping system 250 has a frame portion 252 which is preferably pivotally mounted within the service station frame 52, for example at pivot points 254, 256. Attached to frame 252 are black and color scraper arms 260, 262 which each terminate in a scraper head 264. Each scraper head 264 has an upper scraping edge 266 and a lower scraping edge 268. The upper scraping edge 266 of scraper arms 260, 262 cleans the respective wipers 210, 212 when the tumbler body 202 rotates the wipers in a downward direction (clockwise in FIG. 10), whereas the lower scraping edge 268 cleans the wipers when the wipers are rotated upwardly (counterclockwise in FIG. 10).

Preferably, the tumbler body 202 rotates freely without interference of the scraping system 250 with various components mounted on the tumbler, such as the caps 64, 65. To facilitate this free travel, while still scraping the wipers 210, 212, the scraping system 250 includes a camming system 270, which controls the pivotal motion of the scraping system 250 with respect to the service station frame 52. As best shown in FIG. 9, the illustrated camming system 270 includes a cam arm 272 extending from the scraper frame 252. The cam arm 272 has a cam follower 274 that engages a cam surface 275 formed along the outer surface of the tumbler rim 205.

FIGS. 12–15 illustrate the position of the tumbler body 202 for wiping printheads 34, 36 with wipers 210, 212, as well as illustrating the optional wiper cleaning method using the scraping system 250. The scraper frame 252 includes a cantilever spring or biasing arm 276, which rides along an end portion of a biasing post 278 extending upwardly from the service station frame bottom wall 73. The cantilever spring arm 276 pushes against the biasing post 278 to move the scraper heads 264 away from the tumbler 202. The spring arm 276 has resilient properties allowing it to compress slightly in response to the camming action provided by cam system 270, so the scraper blades are drawn into engagement with the wipers 210, 212 in response to rotation of the tumbler body 202.

Figure 12:
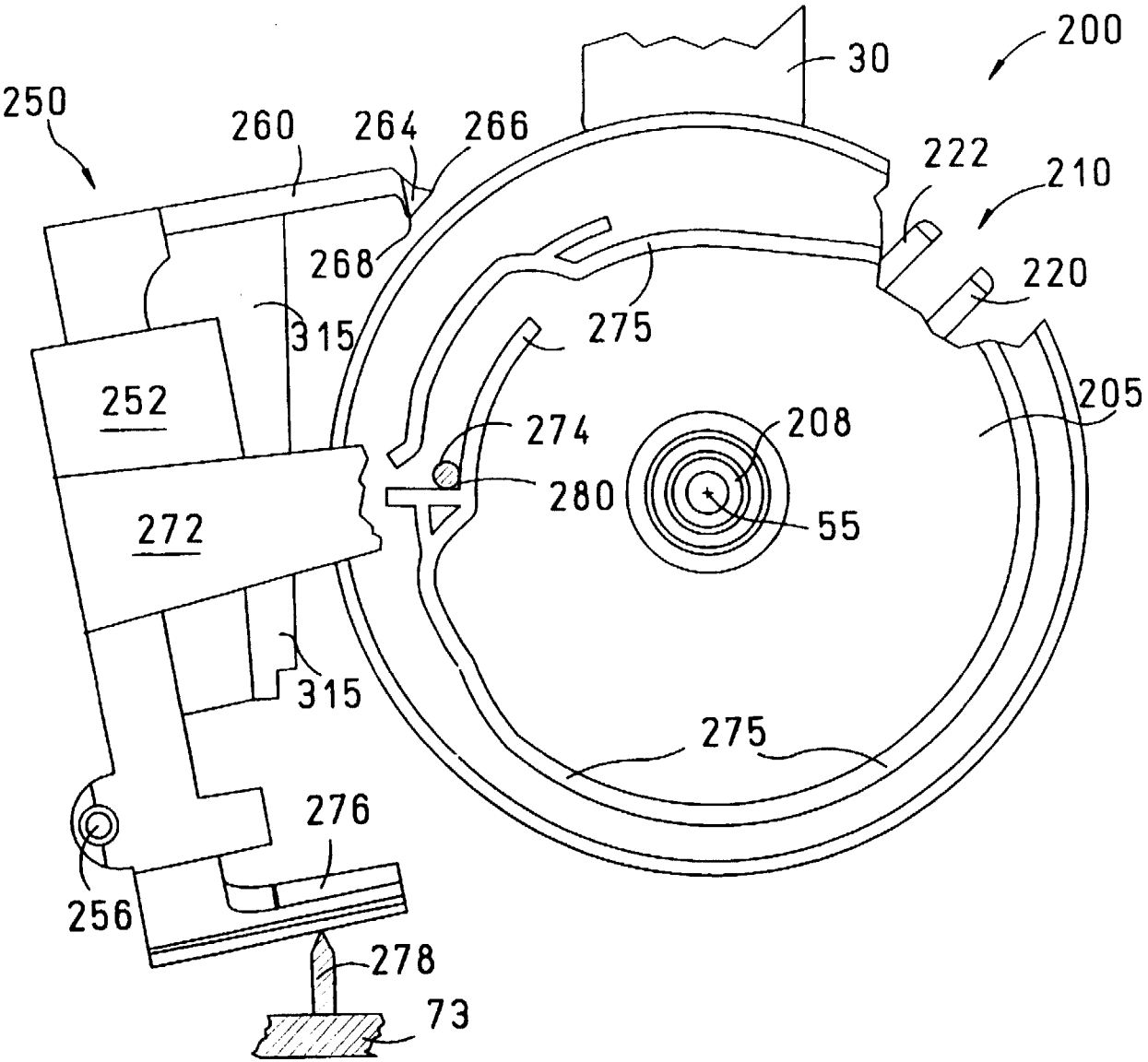
FIGS. 12–15 are partially schematic side elevational views of the rotary wiping and wiper scraping systems of FIGS. 9 and 10, showing various stages of operation.

For simplicity, FIGS. 12–15 illustrate operation of the rotary station 200 in wiping only the black pen 30 with the black ink wiper 210, although it is apparent that the color wiper 212 may simultaneously wipe the color pen 32 in the same fashion. In FIGS. 12–15, the black pen 30 is shown positioned above the rotary service station 200 for servicing. FIG. 12 shows a prewipe position, which is nominally defined here as the 0° position. At this point, the scraper cam follower 274 is bottomed out on the tumbler cam surface 275, at location 280.

Figure 13:
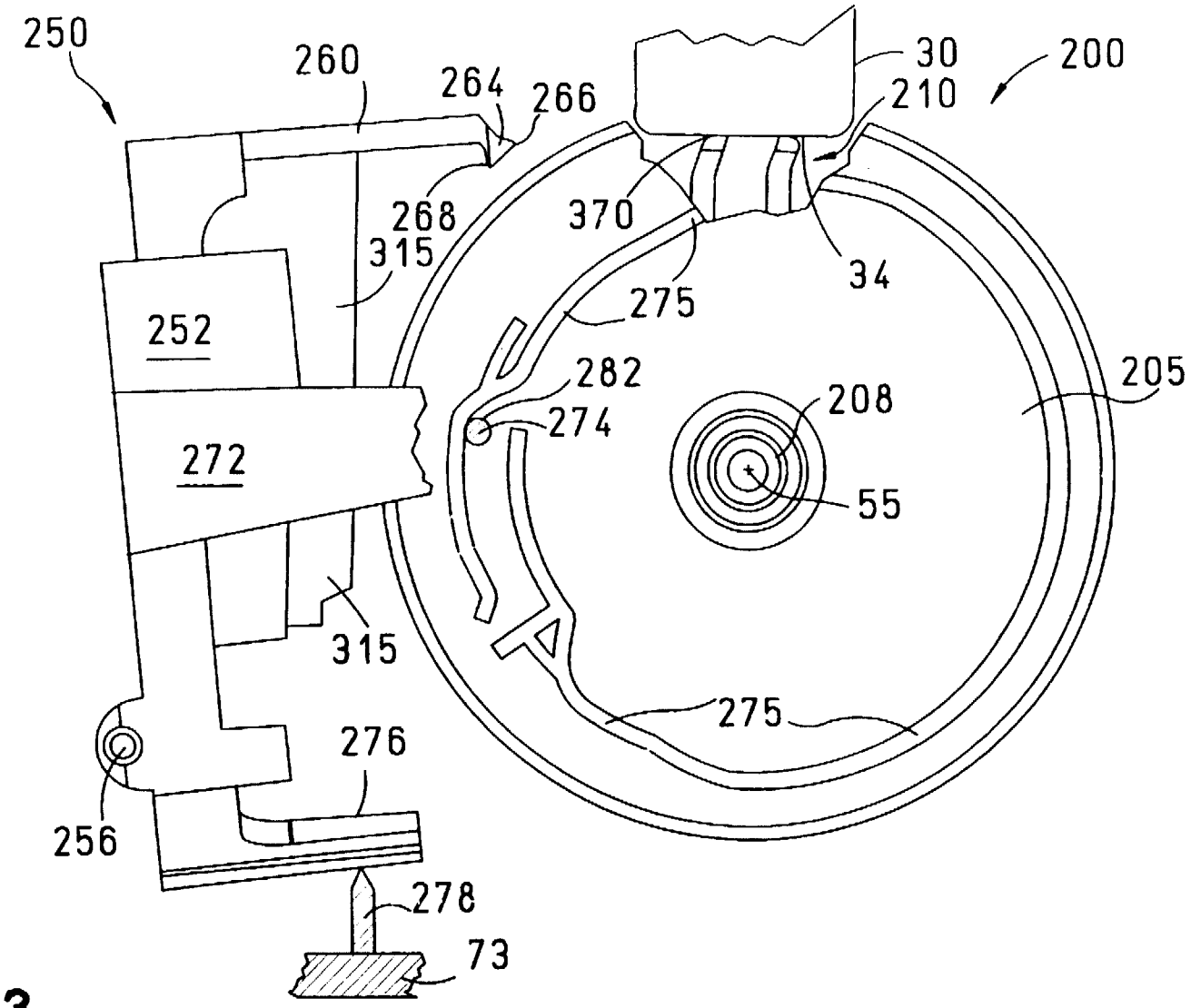
Figure 14:
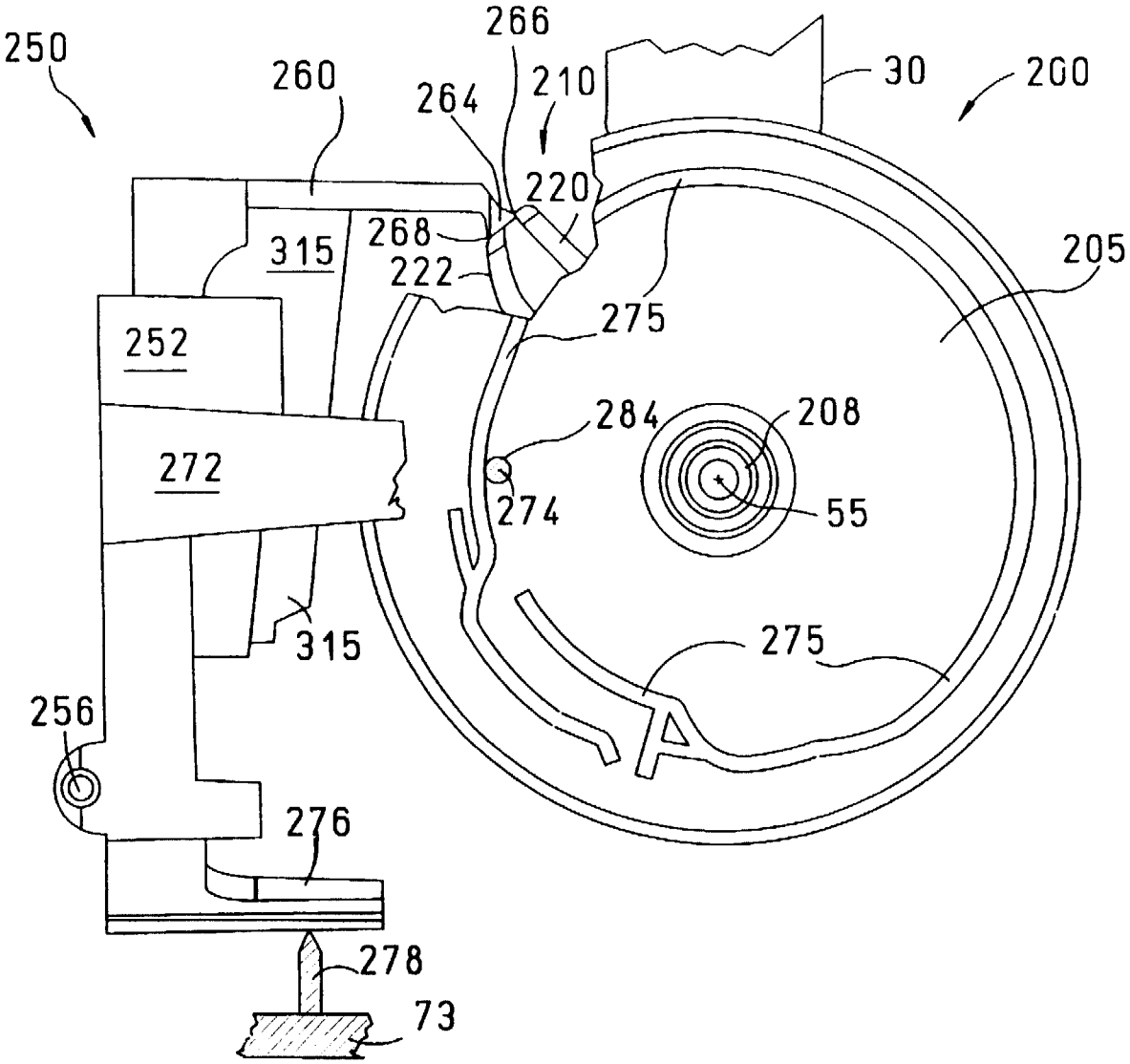

FIG. 13 shows the printhead 34 being wiped by the blades of wiper 210, which flex when contacting the pen face plate. At this point, the scraper cam follower 274 is at location 282 of cam 275. FIG. 14 shows the scraping of the wiper 210 by the upper edge 266 of the scraper head 264. In this position, the cam follower 274 is at location 284 of cam 275. In comparing the position of the scraper arm 260 and frame 252 shown in FIGS. 12 and 13, with that shown in FIG. 14, it is apparent that the frame 252 has been pivoted around pivot posts 254 (FIG. 10) and 256 to draw arm 260 into a wiper engaging position.

Figure 15:
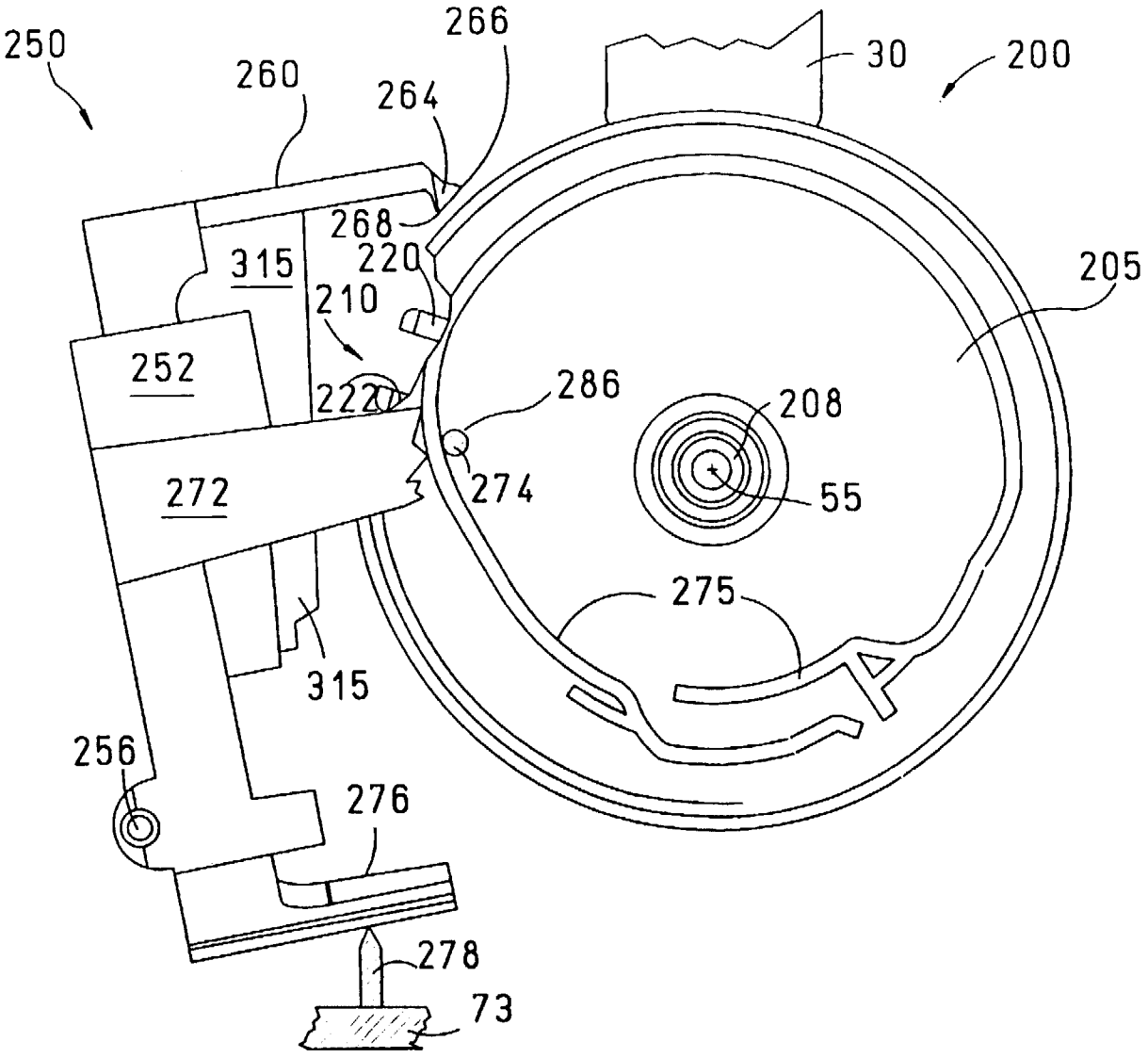

In FIG. 15, the end of wiper scrape position is shown, with the scraper member 260 pivoted back into a free travel or rest position, so as not to interfere with rotation of the tumbler body 202. At this end-of-wipe scraping position, the tumbler body 202 has rotated about 100° from the nominal position shown in FIG. 12. In FIG. 15, the cam follower 274 is positioned at location 286 of the cam surface 275. In this progression, with the tumbler having turned counterclockwise (FIGS. 9, 12–15) from the prewipe position of FIG. 12 to the post-wipe position of FIG. 15, only the upper scraper edge 266 was used to remove ink residue and debris from the wiper 210. If the direction of rotation were reversed, moving clockwise from the position of FIG. 15, for instance, after the pen 30 had been moved from the region of the service station 200, then the lower edge 268 of the scraper head 264 engages and scrapes residue from the wiper 210. Reciprocal rotation for repeated scraping of the wipers 210, 212 may be useful in some servicing schemes.

Figure 16:
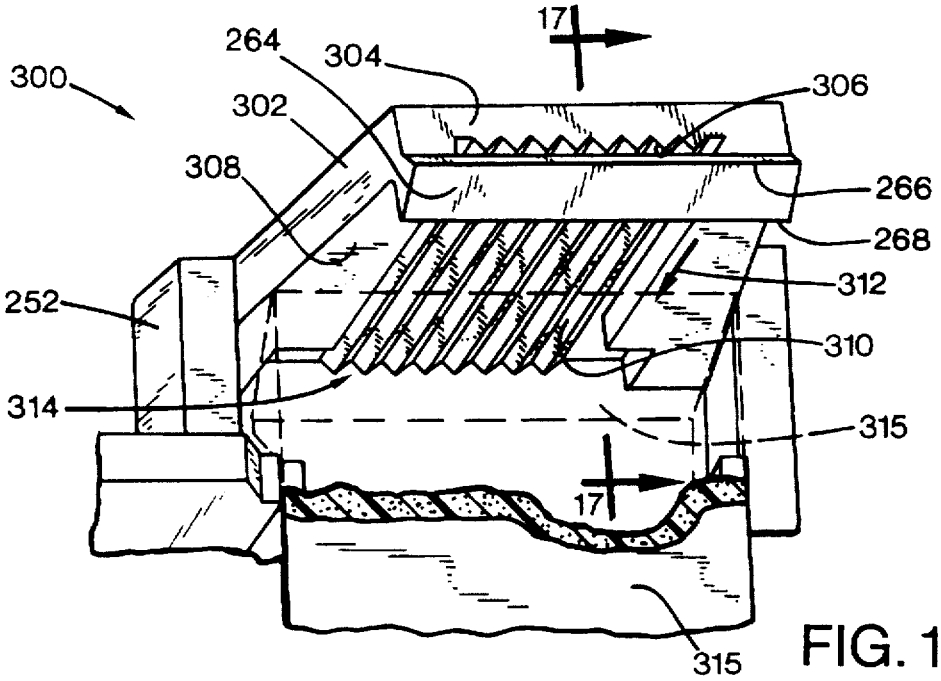
FIG. 16 is an enlarged perspective view of an alternate embodiment of a self-draining scraper arm of the wiper scraping system of the present invention.
Figure 17:
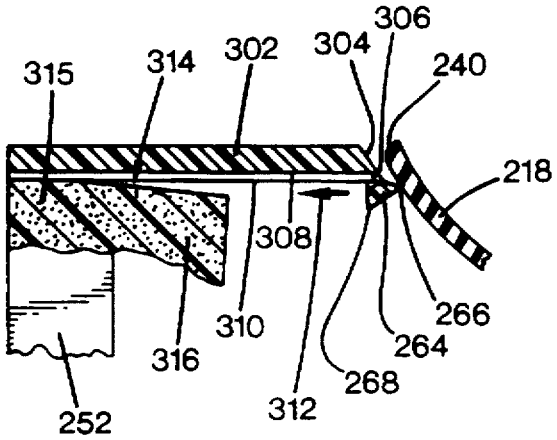
FIG. 17 is a side elevational sectional view taken along lines 17—17 of FIG. 16.

FIGS. 16 and 17 show an alternate self-draining scraper arm assembly 300, constructed in accordance with the present invention, for use with the wiper scraping system 250. The self-draining scraper assembly 300 has a color scraper arm 302 which is substituted for the scraper arm 262. The draining arm 302 scrapes the color wiper 212, shown here for simplicity wiping only one blade 218. While only the color scraper arm 302 is illustrated, it is apparent that the black scraper arm 260 may be constructed in the same fashion to be self-draining. Through standard operation of scraper system 250, ink may build up on the scraper edge 266. The scraper drain system 300 maintains a clean scraper, thus aiding in nozzle reliability by preventing ink build up on the scraper heads 264 which may adversely affect regular wiping operations.

The arm 302 extends outwardly from the scraper frame 252, and terminates in a nose portion 304 from which the scraper head 264 extends. The nose portion 304 defines a drain orifice 306 therethrough. The arm 302 has an under surface 308 configured to define a series of fluid communicating troughs or channels 310. The drain orifice 306 serves as an inlet to the channels 310. Before the ink residue has a chance to build up significantly, the liquid ink residue scraped from the wiper 212 enters the drain orifice 306. These channels 310 carry the liquid residue to the rear of the blotter frame 252 under the forces of gravity and capillary action in the direction indicated by arrow 312 toward an absorbent region 314. The term "drain" as used herein includes the concept of moving liquid through the forces of capillary action, as well as any movement induced by gravity. Indeed, the prominent motive force which propels the liquid residue along the scraper arms 260, 262 is believed to be capillary in nature.

In the area of the absorbent region 314, the channels 310 are in wicking contact with a portion of an absorbent blotting pad member 315. The blotting pad 315 absorbs the liquid ink residue and assists in promoting the capillary draw of the ink along the channels 310. The pad 315 may be of any type of liquid absorbent material, such as of a felt, pressboard, sponge or other material. Preferably, the blotting pad 315 is of a material that pulls up an average of 1.5–2.0 grams, or more preferably about 1.7 grams of ink per 10 seconds for a pigment based ink, within a volume that fits into the scraper frame 252. More preferably, the blotting pad 315 is of a polyolefin material, such as a polyurethane or polyethylene sintered plastic, a porous material, more particularly that manufactured by the Porex company of Atlanta, Georgia. Alternatively, the blotting pad 315 may be of a cellulose acetate material, such as an extruded acetate fiber bundle that is made by American Filtrona of Richmond, Virginia. Preferably, the exterior surface of the blotter pad 315 is treated with surfactants, such as fluorosurfactants, which aid in drawing the ink deep into the pad 315 through capillary action by increasing adhesion of ink into the surfaces of the pad.

Preferably, the scraper drain 306 is of a minimum size to maximize the wicking action. The capillary channels 310 are also sized to the smallest, manufacturable size to insure capillary draw all along the scraper arm 302. When the blotter pad 315 is inserted into the blotter frame 252 it contacts the capillary channels 310 at the rear of the blotter frame in the absorbent region 314, as shown by the dashed lines in FIG. 16, and as also shown in cross section in FIG. 17. The advantages of the self-draining scraper assembly 300 include the significant reduction of ink build up on the scraper edge 266, which leaves the scraper head 264 cleaner, so it can, in turn, provide better servicing of the standard wiper.

Wiping Method

Figure 18:
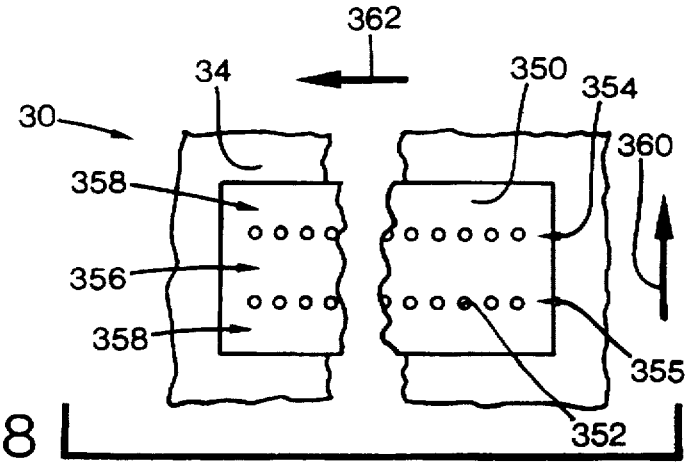
FIG. 18 is a bottom plan view of an inkjet printhead showing a method of wiping a printhead in accordance with the present invention.

In operation, the rotary service station 200 provides one illustration of a wet wiping system that wicks ink from the pens 30, 32 to assist in lubricating the pen face and dissolving any ink residue accumulated on the pen face. FIG. 18 shows an enlarged bottom plan view of a portion of the printhead 34 of pen 30. The black printhead 34 has a nozzle plate or pen face 350, with a group of nozzles 352 extending therethrough. The nozzles 352 are arranged on the pen face 350 in two columns or linear arrays 354, 355, which are separated by a central nozzle-free region 356, and flanked by two outboard nozzle-free regions 358. The linear nozzle arrays 354 and 355 are substantially perpendicular to the scanning axis 41 of the pen carriage 38 (FIG. 1). It is apparent that the nozzle arrays 354, 355 in a pen may have some manufacturing variation in the alignment of the nozzles. Thus, the term "linear" as used herein may be interpreted as "nearly linear" or substantially linear, and may include nozzle arrangements slightly offset from one another, for example, in a zigzag arrangement.

In the illustrated embodiment, each array 354, 355 has one hundred and fifty nozzles 352, which may be arranged side by side as shown, or more preferably, are in a staggered arrangement in the scan axis, for hydraulic reasons internal to the pen 30. The nozzles of the illustrated color pen 32 are also arranged in linear arrays which are parallel to the black nozzle arrays 354, 355, with two arrays per color on the printhead 36. It is apparent that the concepts of the wet wiping system illustrated herein may be applied to other nozzle arrangements and pen installations.

Referring back to FIG. 3, the service station 50 has wipers 66 and 68, which may be rotated into the upright position occupied by caps 64 and 65 in FIG. 3, to wipe the respective printheads 36, 34. With the wipers 66, 68 rotated into the upright position, the pens 32, 30 are reciprocated across the wipers 66, 68 in the scanning direction 41 (FIG. 1) to facilitate wiping. This wiping system is referred to as wiping in a normal direction, as indicated by the arrow 360 in FIG. 18. In the past, normal direction wiping was implemented in a variety of translational wiping platforms, and was particularly well suited for earlier pens that used dye based inks.

In contrast, the rotary senice station 200 wipes printheads 34, 36 by holding the pens 30, 32 stationary over the service station, and then rotating the wipers 210, 212 about the tumbler axis 55 over the pen faces to facilitate wiping. This new wiping system is referred to as wiping in an orthogonal direction, as indicated by arrow 362 in FIG. 18. In comparison, wiping with service station 50 of FIGS. 1–4 moves the wipers 66, 68 first across one linear array and then across the other linear array(s) of the respective printheads 36, 34. In contrast, the orthogonal wiping scheme of FIGS. 9–18 moves the wipers 210, 212 along the length of the linear nozzle arrays 354, 355 in a direction 362 that is parallel to each column of nozzles.

In this orthogonal wiping scheme, as the wipers 210, 212 progress down each nozzle array, such as arrays 352, 354, the wipers wick ink into a capillary channel 370, which is formed between the wiper blade and nozzle plate, as shown in FIG. 13. While such a capillary channel may be formed between both blades of the wipers 210, 212, it is believed that the main capillary draw is provided by the rounded edge 240 of the leading blade in a wipe, with the angular edge 244 of the trailing blade performing a final cleaning wipe. The wiper blades then drag the wicked ink along the nozzle array to adjacent and down stream nozzles, from which ink is also wicked and dragged.

The wicked ink serves to lubricate the wipers 210, 212 and the pen face, such as face 350. The wicked ink from one nozzle is used to lubricate the wiping of the next nozzle, and so down the array. This lubrication lessens the wiping force required to clean the pen faces, so the service station components need not be over designed to handle higher wiping forces. Moreover, high wiping forces which could potentially damage the pen face are avoided by using the wicked ink as a lubricant. This lubrication assist feature was not possible using the normal direction wiping scheme of FIG. 3. In a normal wiping direction 360 any ink wicked from the nozzles is merely distributed in the nozzle free central region 356 between the two nozzle columns 354, 355, or beyond the columns into the outboard regions 358.

The wicked ink also serves to dissolve any ink residue accumulated on the pen face, such as face 350. This wet wiping system also cleans down to the nozzle plate 350 on each wipe to prevent the volcano caldera-like formations which occurred using earlier wipers, as discussed in the background portion above, and using the earlier normal direction 360 wiping schemes. The angular edge 242 advantageously assists in scraping ink and ink residue down the pen face to prevent formation of any ink volcano calderas.

The amount of ink wicked out of each nozzle is believed to be a function of the dimensions of the capillary channel 370, which is in turn a function of the contact angle between the wiper blade and the pen face. It is apparent that using a conventional single bladed wiper with a rectangular wiping tip, such control of the contact angle would be a difficult thing to assure during the manufacturing process. To remedy this difficulty, the wiper blades 220, 222, 216 and 218 have the rounded tip 240 on the outboard side of each blade, to allow a consistent contact angle regardless of the angle of interference between the blade and pen face. It is apparent that a rounded tip may not be required if manufacturing tolerances were held much tighter; however, the rounded tip 240 allows a greater manufacturing process margin in terms of allowable tolerances to provide a lower cost design and a more economical printer 20.

Several advantages are realized using the forked dual blade geometry of the black ink wiper 210 for pens filled with a pigment based ink. The forked geometry of the wiper tips, with two contact surfaces 230 and 232, advantageously reduces the likelihood of creating ink rolls in the nozzle free regions 356, 358, where ink is not available for lubrication. The forked geometry of the wiper tips, as well as the wicked ink, also prevent ink rolls from forming in the immediate vicinity of the nozzles 352. The recessed lands or sections 234, 236 and 238 surrounding the wiping surfaces 232, 234 of blades 220, 222 provide escape passageways for ink rolls to move away from the nozzle columns 354, 355 during wiping. Any ink rolls which form during wiping are forced through the relief recesses formed by shoulders 234, 236, 238, and into the nozzle free regions 356, 358. By diverting the ink rolls into the nozzle free regions, the rolls are not forced into the nozzles by the wipers, as was the case using normal direction 360 wiping, or using a non-forked wiper tip. Thus clogging of nozzles is avoided using the orthogonal direction 362, wet wiping scheme.

Mopping Method For Recovering Crusted Nozzles

Inkjet printheads 34, 36 that are unused for long periods of time can form crusted ink plugs over the nozzles, preventing them from firing. This problem is particularly acute for pens filled with pigment based inks, such as the black pen 30. One earlier method used to solve the crusting problem is known as the spit shine method, and is described in U.S. Pat. No. 5,103,244, issued on Apr. 7, 1992, which is owned by the present assignee. The spit shine method employs spitting on the wiper blade, then slowly wiping the pen back and forth to dissolve the crusted ink, with the wiping being done in the normal direction 360, that is, perpendicular to the nozzle arrays 354, 355.

The mopping method of recovering crusted nozzles, in accordance with the present invention, is similar to the spit shine algorithm in that is uses the wiper to work fresh ink into the pen face 350 to dissolve the crusted ink. However, the mopping method is believed to be unique from the spit shine method in at least two important ways. First, the mopping method does not require spitting ink on the wiper blades. This feature of the mopping routine has several advantages. For instance, tests have shown that spitting on the wiper blade can actually deprime the nozzles 352. Furthermore, the mopping method does not rely on many of the nozzles still being functional, whereas the spit shine method, by definition, needs to have some of the nozzles operating to spit on the wiper. Another disadvantage of the spit shine method is the amount of accumulated ink residue on the wipers due to spitting on the wipers, which could lead to impeding wiper movement, particularly with the high solids content, pigment based inks. Moreover, less ink is wasted using the mopping method, rather than spit shine.

The second point of distinction between the spit shine and mopping methods is the wiping direction relative to the nozzle columns 354, 355. In the mopping method, the wiping is done orthogonally by running the wipers 210, 212 parallel to the nozzle arrays as indicated by arrow 362, rather than perpendicular or normal to the arrays according to arrow 360. Using orthogonal wiping in the mopping method, ink that is wicked out of one nozzle is brought immediately to the next nozzle, where it is used to dissolve any crusted ink plugs. With the spit shine method, the ink removed from one nozzle is dragged across the nozzle plate central region 358 before reaching another nozzle, which makes more of a mess rather than being put to use cleaning nozzles.

In an illustrated embodiment of the mopping method, a method is described of recovering normal operation of printheads 34, 36 when they have at least some of their nozzles obstructed from normal operation because they are clogged with crusted ink. For simplicity, the method is illustrated with reference to the black pen 30 and wiper 210. This mopping recovery method includes the step of slow wiping the face plate 350 through relative motion of a wiper 210 and the face plate 350 along the length of the linear nozzle array 354, 355 to extract ink through capillary action from one nozzle 352, and to move the extracted ink along the face plate 350 with the wiper. In a scraping step, ink residue is scraped from wiper 210 after the slow wiping step using the scraper arm 260. The method also includes the step of fast wiping the face plate through relative motion of the wiper and face plate along the length of the linear nozzle array.

In the illustrated mopping method, the slow wiping step may include the step of lubricating the face plate 350 using the extracted ink. The slow wiping step may also include the step of moving the extracted ink to a second nozzle, and dissolving any ink residue adjacent this second nozzle using the extracted ink. In the printer 20, the inkjet printhead 34 traverses along a scanning axis 41, and the slow and fast wiping steps each comprise rotating the wiper 210 about the tumbler axis 55, which is substantially parallel to the scanning axis 41. The scraping step may include the step of rotating the wiper 210 about the tumbler axis 55 to scrape the wiper with the scraper 260, with the method further including the step of moving the scraper 260 into a scraping position, as shown in FIG. 14, as the cam follower 274 traverses the cam surface 275 from the wiping position 282 to the scraping position 284. In the slow wiping step, the face plate 350 may be slowly wiped orthogonally by moving the wiper bi-directionally across the face plate, in the direction indicated by arrow 360, and opposite arrow 360. This method may also include the step of purging the printhead by ejecting ink droplets into a waste receptacle, such as the spittoon 70.

In one preferred embodiment, the mopping method also includes the step of performing an initial purging cycle comprising the printhead ejecting ink into a waste receptacle before the slow wiping step. In another step, an intermediate purging cycle is performed where the printhead ejects ink into a waste receptacle, such as the spittoon 70, after the scraping step. In a further step, a final purging cycle is performed where the printhead ejects ink into spittoon 70 before beginning printing. This method may also include the step of repeating the slow wiping, scraping, intermediate purging and fast wiping steps prior to the final purging step.

In one implementation, the initial purging cycle comprises ejecting a first number of ink droplets per nozzle, and the slow wiping step comprises wiping the face plate two to twenty times. The intermediate purging cycle may comprise ejecting 2–10% of the first number of ink droplets per nozzle, while the fast wiping step comprises wiping the face plate at least once. The final purging cycle may comprise ejecting 95–105% of the first number of ink droplets per nozzle.

For example, during the initial purging step 2000 drops per nozzle 352 are spit from each pen 30, 32 into the spittoon 70. The pens 30, 32 are then moved over the service station wipers 210 and 212, where they are first wiped several cycles at a slow speed, on the order of about one inch per second. After slow wiping, the wipers 210, 212 are rotated to the scraping position (FIG. 14) and scraped to remove any ink residue by rotating the wipers past the scrapers 260 and 262. In the intermediate purging step, the pens 30, 32 are moved over the spittoon 70 and spit 100 drops per each nozzle. In the fast wipe step, the pens 30, 32 are wiped a single cycle at fast speed, on the order of about two inches per second. These steps of slow wiping, scraping, and fast wiping are repeated several times before the final purging step. In the final purging step, the pens 30, 32 are moved over the spittoon and spit 2000 drops per nozzle. After this final purging step, the once crusted nozzles are assumed to have been recovered to full operational capacity, and the printer 20 is ready to receive printing instructions.

Many variations of the mopping method are possible while maintaining the basic concept of wicking ink from the pens, then using the wicked ink to clean any crusted nozzles. In one example, the slow wiping step may comprise using a short back and forth motion of the wipers 210, 212 across the nozzle plate, which may enhance the recovery action by massaging the pen face with fresh ink. The illustrated mopping has been tested and shown to be effective at recovering crusted nozzles, including those using pigment based inks.

Advantages of Orthogonal Wet Wiping

A variety of advantages are realized using the orthogonal wet wiping system described herein. For example, the wet wiping system 200 advantageously solves the previously encountered ink roll problem, which is characteristic of pigment based inks. The orthogonal wiping scheme also solves the volcano caldera phenomenon of ink residue build up around the nozzles 352, as well as curing the dry ink problems associated with the pigment based inks. Using the ink itself to lubricate the pen face 350 extends wiper life. Additionally, the rounded portion 240 of the wiping tip allows for less stringent manufacturing tolerances, which facilitates the manufacture of a more economical printer 20.

With the orthogonal wiping method, significantly cleaner nozzle plates are achieved, which yields a higher print quality. Using the wicked ink as a solvent for cleaning dried ink and removing any plugs from nozzles, restores the nozzles to good health for maintaining high quality printing. This method, as well as the rotary wiping apparatus 200, require less force of the wipers against the nozzle plate 350, so smaller more economical motors may be used to drive the service station wipers. Furthermore, a narrower printer is achieved, since no carriage over-travel is required to activate the service station, as was the case in earlier printer designs. Thus, a narrower printer footprint, that is a smaller work surface space is needed to accommodate the printer 20 during use.

We claim:

1. A service station for servicing an inkjet printhead of an inkjet printing mechanism, the printhead having a face plate defining a group of ink ejecting nozzles extending therethrough in a linear array, comprising:

a platform; and a printhead wiper supported by the platform to wipe the face plate parallel to the linear nozzle array through relative motion of the platform and the face plate, with the printhead wiper having a wiping edge configured to, during wiping, wick ink through capillary action from nozzles in the array into a capillary channel defined between the wiping edge and the face plate, and to move the wicked ink to other nozzles in the array to dissolve any ink residue adjacent thereto.

2. A service station according to claim 1 wherein said wiping edge comprises a rounded wiping edge.

3. A service station according to claim 2 wherein the printhead wiper comprises two wiper blades, with the wiper blade that first encounters the nozzles during a wiping stroke having the rounded wiping edge wiping the face plate, and with the other wiper blade that encounters the nozzles last having an angular wiping edge that wipes the wicked ink and any dissolved ink residue from the face plate adjacent said nozzles and said other nozzles.

4. A service station according to claim 1 wherein:

the platform is moveable in a wiping direction to provide said relative movement; and the printhead wiper wipes the face plate parallel to the linear nozzle array when the platform is moved in the wiping direction.

5. A method of wiping an inkjet printhead of an inkjet printing mechanism, the printhead having a face plate defining a group of ink ejecting nozzles extending therethrough in a linear array, comprising the steps of:

positioning a wiping edge of a wiper to engage the face plate;

wiping the face plate through relative motion of the wiper and face plate along the length of the linear nozzle array; and during the wiping step, wicking ink with the wiping edge from the nozzles through capillary action into a capillary channel defined between the wiping edge and the face plate, moving the wicked ink to other nozzles in the array, and dissolving ink residue accumulated on the face plate adjacent said other nozzles using the wicked ink.

6. A method according to claim 5 wherein the wicking step comprises the steps of forming a capillary channel between the wiping edge and the face plate, and drawing ink from the nozzles through capillary action into the capillary channel.

7. A method according to claim 5, wherein said wiping edge comprises a rounded wiping edge of the wiper, and the wicking step comprises wicking ink with the rounded wiping edge, and the moving step comprises moving the wicked ink with the rounded wiping edge.

8. A method according to claim 5, wherein the wiping step comprises moving the wiper through a wiping stroke.

9. A method according to claim 5, step of, after the moving step, wiping the wicked ink from the face plate adjacent said nozzles and said other nozzles with an angular wiping edge of a second wiper.

10. A method according to claim 5, wherein:

the wiper comprises a dual blade wiper having a pair of wiper blades, with one wiper blade having said wiping edge comprising a wicking edge and the other wiper blade having a cleaning wiping edge; and the wiping step comprises the steps of wicking ink from said nozzles with the wicking edge of said one wiper blade, and thereafter, cleaning any dissolved ink residue and moved wicked ink from the face plate using the cleaning edge of said other wiper blade.

11. A method according to claim 10, wherein each wiper blade of the pair has a wicking edge and a cleaning edge arranged for bi-directional wiping of the linear nozzle array so the wicking edge of the leading blade in a wiping stroke first contacts the nozzles followed by the cleaning edge of the trailing blade.

12. A method according to claim 5, wherein:

the positioning step comprises rotating the wiper into engagement with the face plate; and the wiping step comprises rotating the wiper to wipe the face plate.

13. A method according to claim 12, wherein:

the method further includes the step of moving the printhead along a scanning axis into a position for engagement with the wiper; and the rotating portion of the positioning and wiping steps each comprises the step of rotating the wiper about a first axis substantially parallel to the scanning axis.

14. A method according to claim 5, wherein:

the inkjet printing mechanism comprises plural printheads;

the positioning step comprises positioning plural wipers supported on a single moveable platform by moving the platform so each wiper engages the face plate of a respective one of the plural printheads; and the wiping step comprises wiping the face plates of each of the plural printheads with said respective one of the plural wipers.

15. A method of wiping an inkjet printhead of an inkjet printing mechanism, the printhead having a face plate defining at least two adjacent ink ejecting nozzles extending therethrough, comprising the steps of:

wiping the face plate through relative motion of a wiper and the face plate;

extracting ink from one nozzle through capillary action during the wiping step into a capillary channel defined between the wiper and the face plate; and moving the extracted ink along the face plate with the wiper to at least one other nozzle and dissolving any ink residue adjacent thereto with the extracted ink.

16. A method according to claim 15, wherein:

the wiping step comprises moving a rounded wiping edge of the wiper across the face plate;

the extracting step comprises forming a capillary channel between the rounded wiping edge and the face plate to draw ink through capillary action from said one nozzle into the capillary channel; and the moving step comprises dragging the extracted ink with the rounded wiping edge along the face plate.

17. A method according to claim 16, wherein the method further includes the steps of cleaning the extracted ink and any dissolved ink residue from the face plate using a cleaning edge of a second wiper during at least a portion of the wiping step.

18. A method according to claim 15, wherein:

the wiper comprises a dual blade wiper having a pair of wiper blades;

the extracting step comprises the step of extracting ink from said one nozzle with a rounded wiping edge of a first one of the blades; and the moving step comprises the step of moving the extracted ink with a second one of the blades to contact said one nozzle.

19. A method of recovering normal operation of a inkjet printhead of an inkjet printing mechanism, the printhead having a face plate defining a group of ink ejecting nozzles extending therethrough arranged in a linear array, with at least some of the nozzles having crusted ink formed therein to obstruct normal operation, the recovery method comprising the steps of:

wiping the face plate through relative motion of a wiper and the face plate along the length of the linear nozzle array to extract ink from the nozzles through capillary action into a capillary channel formed between the face plate and the wiper when adjacent the nozzles, and to move the extracted ink along the length of the linear nozzle array with the wiper, first in a slow wiping step and then in a fast wiping step which is faster than the slow wiping step; and scraping ink residue from the wiper after the slow wiping step.

20. A method according to claim 19, wherein the wiping step comprises step of cleaning the extracted ink from the face plate using a cleaning edge of a second wiper which also wipes the face plate during said relative motion.

21. A method according to claim 19, wherein the slow wiping step comprises the step of moving the extracted ink to another nozzle, and dissolving ink residue adjacent said another nozzle using the extracted ink.

22. A method of wiping an inkjet printhead of an inkjet printing mechanism, the printhead having a face plate defining a group of ink ejecting nozzles extending therethrough in a linear array, comprising the steps of:

positioning the face plate and a wiping edge of a wiper into mutual engagement;

forming a capillary channel between the wiping edge and the face plate adjacent the nozzles; and drawing ink from the nozzles through capillary action into the capillary channel.

23. A method according to claim 22 further including the steps of:

after the drawing step, moving the drawn ink across the face plate to other nozzles in the array; and dissolving ink residue accumulated on the face plate adjacent said other nozzles using the drawn ink.

* * * * *

UNITED STATES PATENT AND TRADEMARK OFFICE

CERTIFICATE OF CORRECTION

PATENT NO. : 5,896,145

DATED : April 20, 1999

INVENTOR(S) : Osborne et al.

It is certified that error appears in the above-identified patent and that said Letters Patent is hereby corrected as shown below:

Column 2, (line 62), delete "Than" and insert therefor --than--.
Column 3, (line 8), delete "increasing" and insert therefor --increase--.
Column 7, (line 61), delete "Function" and insert therefor --functions--.
Column 9, (line 10), after "support" delete "an".
Column 9, (line 48), delete "152 and 152" and insert therefor --152 and 154--.
Column 10, (line 61), delete "comers" and insert therefor --corners--.
Column 15, (line 32), delete "senice" and insert therefor --service--.
Column 16, (line 64), delete "is" and insert therefor --it--.
Column 19, (line 18), after "ink" delete "through capillary action".
Column 19, (line 50), after "nozzles" delete "through capillary action".
Column 20, (line 1), after "5," insert --further including the--.
Column 20, (line 51), after "nozzle" delete "through capillary action".
Column 21, (line 23), after "nozzles" delete "through capillary".
Column 21, (line 24), before "into" delete "action".

Signed and Sealed this

Twenty-first Day of December, 1999

*Attest:*

Q. TODD DICKINSON

*Attesting Officer*

*Acting Commissioner of Patents and Trademarks*